US011365083B2

(12) United States Patent
Iwata

(10) Patent No.: US 11,365,083 B2
(45) Date of Patent: Jun. 21, 2022

(54) SHEET STACKING APPARATUS AND IMAGE FORMING SYSTEM

(71) Applicant: Toshiyuki Iwata, Yamanashi-ken (JP)

(72) Inventor: Toshiyuki Iwata, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 232 days.

(21) Appl. No.: 16/560,471

(22) Filed: Sep. 4, 2019

(65) Prior Publication Data

US 2020/0087097 A1 Mar. 19, 2020

(30) Foreign Application Priority Data

Sep. 14, 2018 (JP) ..... JP2018-172114
Dec. 28, 2018 (JP) ..... JP2018-247126

(51) Int. Cl.

| | |
|---|---|
| ***B65H 31/20*** | (2006.01) |
| ***B65H 31/34*** | (2006.01) |
| ***B65H 43/00*** | (2006.01) |
| ***B65H 29/20*** | (2006.01) |
| ***B65H 33/08*** | (2006.01) |
| ***B65H 31/38*** | (2006.01) |
| ***B65H 31/10*** | (2006.01) |

(52) U.S. Cl.

CPC ..... *B65H 31/34* (2013.01); *B65H 29/20* (2013.01); *B65H 31/10* (2013.01); *B65H 31/20* (2013.01); *B65H 31/38* (2013.01); *B65H 33/08* (2013.01); *B65H 43/00* (2013.01); *B65H 2511/12* (2013.01); *B65H 2601/252* (2013.01); *B65H 2601/325* (2013.01); *B65H 2701/1916* (2013.01); *B65H 2801/06* (2013.01)

(58) Field of Classification Search

CPC ..... B65H 31/34; B65H 43/00; B65H 29/20; B65H 2701/1916; B65H 2601/252; B65H 33/08; B65H 31/38; B65H 2301/4219

See application file for complete search history.

(56) References Cited

U.S. PATENT DOCUMENTS 6,871,851 B2 * 3/2005 Tamura ..... B65H 31/34 270/58.01
9,434,570 B2 * 9/2016 Matsuo ..... B65H 31/04

FOREIGN PATENT DOCUMENTS

JP 2013-230891 A 11/2013
JP 2014-139105 A 7/2014

* cited by examiner

*Primary Examiner* — Jeremy R Severson
(74) *Attorney, Agent, or Firm* — Manabu Kanesaka

(57) ABSTRACT

To provide a sheet stacking apparatus and image forming system capable of improving alignment characteristics also in the case where an aligning section is not able to act on a sheet discharged onto a stacking tray, the sheet stacking apparatus and image forming system include a stacking tray stacking discharged sheets, a pair of aligning sections capable of shifting in a width direction to align the width direction crossing a direction in which the sheet to stack on the stacking tray is discharged, and a control section that controls a relative position of the aligning sections and the sheet to discharge so that one of the pair of the aligning sections regulates a shift of the sheet stacked on the stacking tray to one direction side in the width direction, when a sheet with a predetermined width in the width direction of the sheet is discharged to the stacking tray.

10 Claims, 20 Drawing Sheets

510··· DISCHARGE ROLLER PAIR
519a, 519b··· ALIGNING MEMBER
E···ENVELOPE
F···FLAP PORTION

SHEET STACKING APPARATUS AND IMAGE FORMING SYSTEM

RELATED APPLICATIONS

The present application is based on, and claims priorities from, Japanese Applications No. 2018-172114 filed Sep. 14, 2018; and No. 2018-247126 filed Dec. 28, 2018, the disclosures of which are hereby incorporated by reference herein in its entirety.

TECHNICAL FIELD

The present invention relates to a sheet stacking apparatus for stacking discharged sheets, and an image forming system for forming images on sheets to discharge to the sheet stacking apparatus.

BACKGROUND ART

Conventionally, as shown in Japanese Patent Application Publication No. 2013-230891, there has been a known sheet stacking apparatus capable of aligning a sheet discharged to a stacking tray for stacking sheets, in a sheet width direction crossing a sheet discharge direction. The sheet stacking apparatus as described in Patent Document 1 is provided with a pair of aligning members capable of shifting in the width direction, above the stacking tray, and when a sheet is discharged to the stacking tray, shifts the pair of aligning members in the width direction to strike opposite ends in the sheet width direction of the sheet, thereby aligning the sheet in the width direction.

At this point, in aligning the width direction of the sheet, there are a method of fixing one of the aligning members as alignment reference, shifting the other aligning member in the width direction to cause a sheet to strike one of the aligning members, and thereby aligning in the width direction, and another method of discharging a sheet to an alignment center of alignment positions, shifting in the width direction of the sheet by nipping the sheet with both of the pair of aligning members, and thereby performing alignment.

These aligning methods are used differently corresponding to stacking conditions and the size and type of the sheet, and therefore, result in a configuration for varying waiting positions of the pair of aligning members and discharge positions of the sheet with respect to the aligning members. The discharge position of the sheet is varied with a shift unit for shifting the sheet in the width direction of the sheet provided inside the apparatus, and the sheet is shifted in the width direction by a predetermined amount inside the apparatus, and then, is discharged onto the stacking tray.

Further, as shown in Japanese Patent Application Publication No. 2014-139105, there is a known configuration which includes a sheet pressing member for pressing the top face of the sheet discharged to the stacking tray, as well as the aligning member for aligning the width direction of the sheet. This is because of controlling a jumping amount of the sheet by pressing the top face of the discharged sheet with the sheet pressing member, and promptly dropping the sheet onto the stacking face to stabilize a behavior of the sheet to stack. Then, in order to produce a certain effect irrespective of sizes of sheets, the sheet pressing member is disposed in the center with respect to a stacking position of the sheet.

DISCLOSURE OF INVENTION

Problems to be Solved by the Invention

However, as in the sheet stacking apparatus described in Japanese Patent Application Publication No. 2014-139105, in the configuration where the sheet pressing member is disposed in the center portion of the stacking position of the stacking tray, a movable range of a pair of aligning members with respect to the sheet width direction is limited by the sheet pressing member. Therefore, it is not possible to perform alignment in the sheet width direction by the aligning member, with respect to sheets with widths smaller than a certain width, and in the case of sheets with small sheet widths, there has been an inconvenience that the sheets are stacked on the stacking tray in a disturbed state.

FIG. 20 illustrates a state in which envelopes are stacked in the sheet stacking apparatus described in the above-mentioned Japanese Patent Application Publication No. 2013-230891. The envelope has a flap portion folded to seal, and when the number of envelopes discharged from a discharge means 1510 increases, the flap portion side is higher corresponding to the number of stacked sheets to generate a height difference between the flap portion side and the sheet face position on the side without the flap portion. By the height difference, there has been the risk that a bunch of stacked envelopes is inclined in the front-rear (right-left in the figure) direction of the apparatus, and disturbs stacking characteristics. Particularly, as the number of stacked envelopes increases, the height difference in the sheet face position increases. Therefore, as the number of stacked sheets increases, alignment characteristics of envelopes on the stacking tray are easier to degrade, and according to the circumstances, there has been the risk that stacked envelopes collapse and fall as shown by the arrow. Therefore, it is necessary to limit the number of stacked sheets on the stacking tray in envelopes with widths smaller than the movable range of the pair of aligning members, and it has been difficult to increase the stacking capacity of envelopes stacked on the stacking tray.

The present invention was made in view of the above-mentioned circumstances, and it is an object of the invention to provide a sheet stacking apparatus and image forming system capable of improving alignment characteristics also in the case where an aligning means is not able to act on a sheet discharged onto a stacking tray, particularly, a sheet having thickness in a part thereof.

Means for Solving the Problem

In order to attain the above-mentioned object, a sheet stacking apparatus of the present invention includes a stacking section that stacks sheets discharged in a predetermined discharge direction from a discharge section, a shift section that shifts a sheet discharged to the stacking section, in a width direction of the sheet crossing the discharge direction, a pair of aligning sections capable of shifting in the width direction to align end edges in the width direction of the sheet discharged to the stacking section on the downstream side from the shift section in the discharge direction, and a control section that controls the aligning sections and the shift section so as to adjust a relative position of the aligning sections and the end edges in the width direction of the sheet discharged, where in discharging a sheet with a width narrower than the sheet capable of being aligned by the pair of aligning sections to the stacking section, the control section controls the aligning sections and the shift section so that a distance between one of the pair of aligning sections and one of the end edges in the width direction of the sheet is narrower than a distance between the other one of the pair of aligning sections and the other one of the end edges in the width direction of the sheet, and that the one of the pair of the aligning sections regulates a shift of the sheet discharged to the stacking section to one direction in the width direction.

Advantageous Effect of the Invention

According to the present invention, it is possible to provide the sheet stacking apparatus and image forming system capable of improving alignment characteristics also in the case where the aligning means is not able to act on the sheet discharged onto the stacking tray.

MODE FOR CARRYING OUT THE INVENTION

A sheet stacking apparatus of this Embodiment and an image forming apparatus provided with the sheet stacking apparatus will be described below based on FIGS. 1 to 19C. In addition, disclosed components described in the following Embodiment are thoroughly illustrative, and the present invention according to the scope of the claims is not limited to only the disclosed components.

Figure 1:
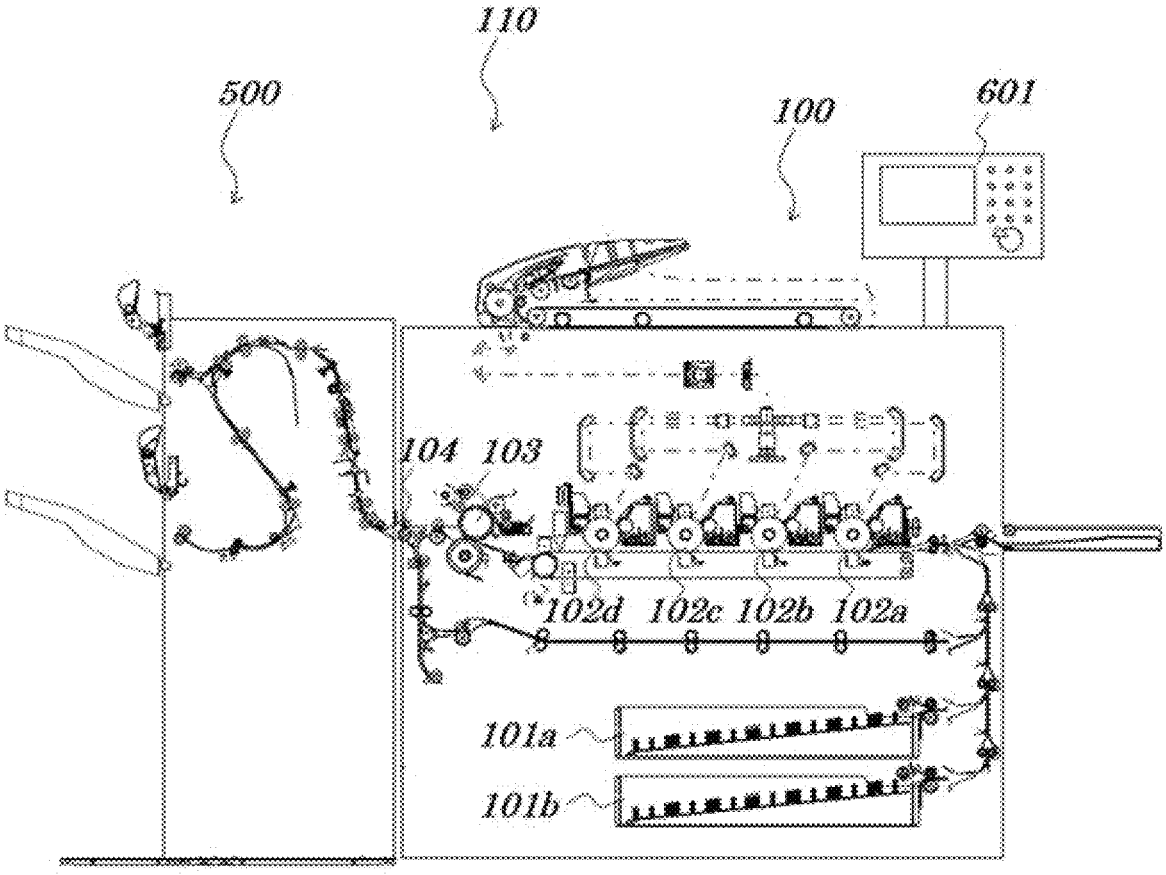
FIG. 1 is a cross-sectional view of an image forming apparatus of the present invention.

As described in FIG. 1, an image forming apparatus 110 is comprised of an apparatus main body 100, and a sheet stacking apparatus 500 connected to the apparatus main body 100. To each of sheets supplied from cassettes 101*a*, 101*b* inside the apparatus main body 100 is transferred a toner image of four colors by photoconductor drums 102*a* to 102*d* of yellow, magenta, cyan and black as respective image forming means, and the like, and after the sheet is transported to a fuser 103 to fuse the toner image, the sheet is discharged from the apparatus main body 100 to the sheet stacking apparatus 500 with a discharge roller 104.

Figure 2:
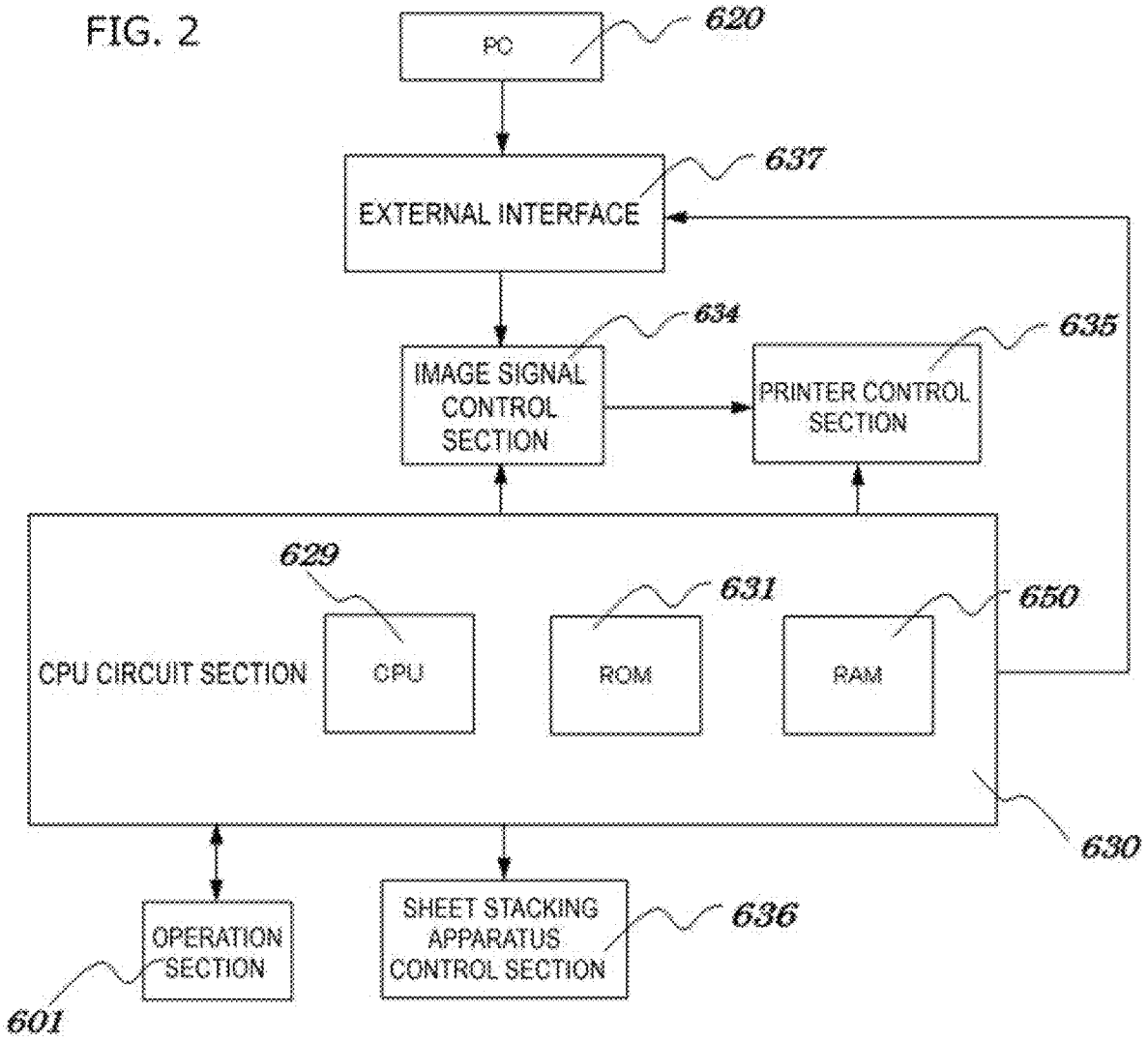
FIG. 2 is a block diagram of the image forming apparatus.

FIG. 2 is a block diagram of an apparatus control section for controlling the image forming apparatus 110. A CPU circuit section 630 has a CPU 629, ROM 631 and RAM 650. The CPU circuit section 630 controls an image signal control section 634, printer control section 635, sheet stacking apparatus control section 636, and external interface 637. The CPU circuit section 630 performs control according to programs stored in the ROM 631, and settings of an operation section 601. The printer control section 635 controls the apparatus main body 100, and the sheet stacking apparatus control section 636 controls the sheet stacking apparatus 500. The RAM 650 is used as an area to temporarily hold control data, and an operation area of computations associated with control. The external interface 637 is an interface from an external computer (PC) 620, and the PC 620 and CPU circuit section 630 communicate signals in the interactive direction through the external interface 637. Further, the PC 620 sends print data to the image signal control section 634 via the external interface 637, and the image signal control section 634 decompresses the sent print data to an image to output to the printer control section 635. Then, the image signal output to the printer control section 635 from the image signal control section 634 is input to an image forming section shown in FIG. 1.

Figure 3:
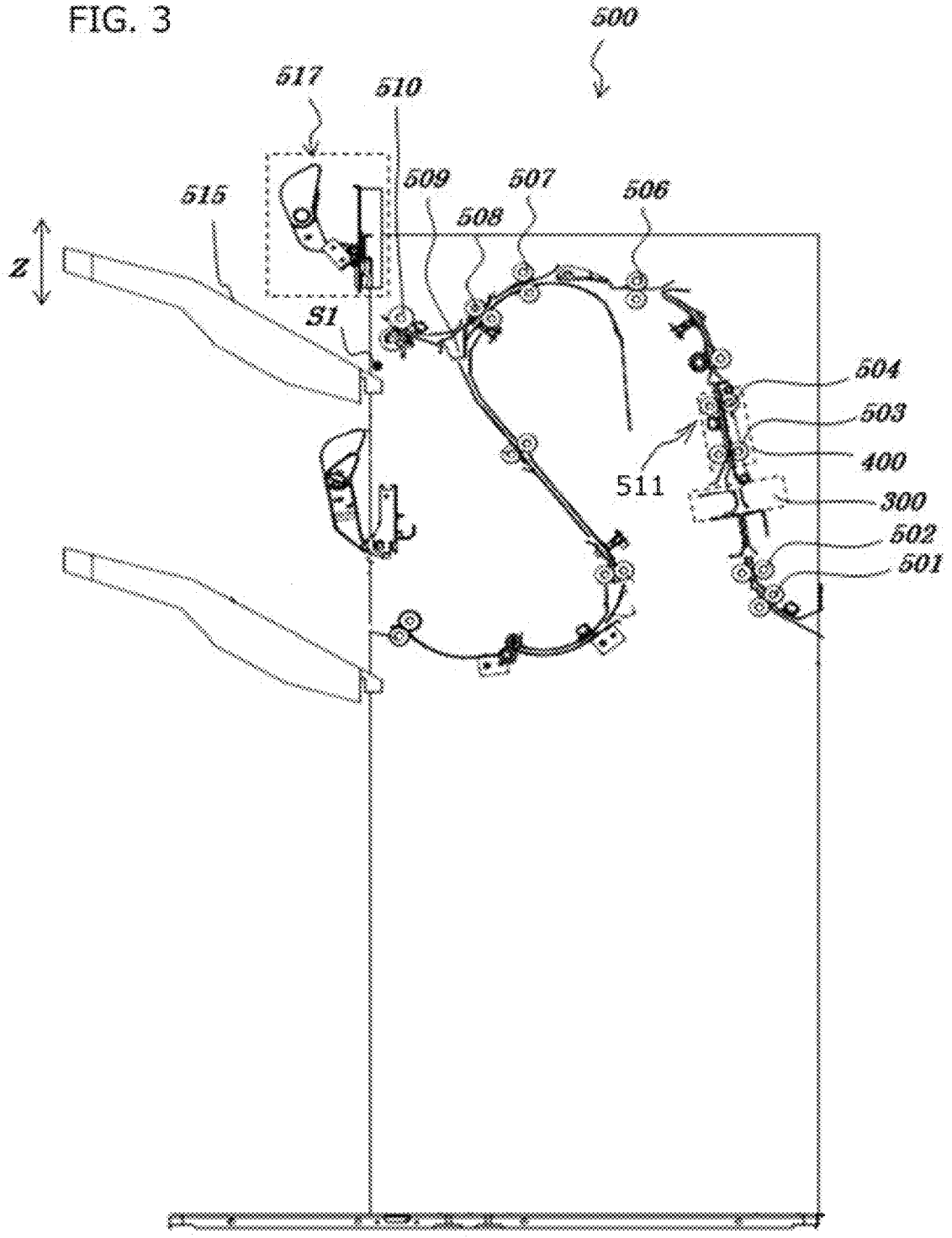
FIG. 3 is a cross-sectional view of a sheet stacking apparatus.

Next, the sheet stacking apparatus 500 will be described in detail. As shown in FIG. 1, the sheet discharged from the apparatus main body 100 is sent to the sheet stacking apparatus 500. As shown in FIG. 3, the sheet stacking apparatus 500 is provided with an entrance roller 501, on the upstream side of a sheet transport path 511 extending from the upstream side to the downstream side in a direction in which the sheet is transported, to introduce various kinds of sheets discharged from the apparatus main body 100. The sheet received in the entrance roller 501 is transported to an entrance transport roller pair 502, and transport means (shift transport roller pairs) 503, 504 inside a shift unit 400, subsequently transported to discharge transport roller pairs 506 to 508 sequentially, and is stacked on a stacking tray 515. Further, in order to facilitate a sort for each sheet in discharging the sheet to the stacking tray 515, the sheet stacking apparatus 500 has a sort processing function capable of displacing the sheet in a direction crossing the transport direction by a predetermined width to stack. The sort processing function is performed by sheet shift means (shift unit) 400 provided in the sheet transport path 511. This Embodiment provides a configuration for enabling the sheet stacking apparatus 500 to be attached to the image forming apparatus 110 as an option, and it is also possible to provide a configuration where the sheet stacking apparatus 500 is incorporated into the image forming apparatus 110. Further, it is also possible to make the stacking tray a configuration of one stage, or two or more stages, and the number of stages is not limited.

A horizontal register detecting unit 300 is provided on the upstream side of the shift unit 400. The horizontal register detecting unit 300 is started by a user selecting sort processing in the operation section 601, and detects a position in the direction (hereinafter, referred to as sheet width direction) crossing the transport direction of the sheet undergoing the sort processing by the shift unit 400. When the horizontal register detecting unit 300 detects the position in the sheet width direction, based on the detection result, the shift unit 400 shifts in the direction crossing the sheet transport direction.

Subsequently, the sheet sent to the discharge transport roller pair 508 is stacked on the stacking tray 515 from the discharge roller pair 510, by a switch flapper 509 disposed on the downstream side. The sheet stacked on the stacking tray 515 is aligned in the sheet width direction crossing the sheet discharge direction by an aligning section 517. In the case where a plurality of stacking trays exists, the sheet is stacked on another stacking tray via a discharge roller switched by the switch flapper 509.

The sheet stacking apparatus 500 is provided with a sheet top face detecting sensor S1 as a sheet top face detecting means to detect the uppermost face of sheets stacked on the stacking tray 515. By moving the stacking tray 515 up and down in the arrow Z direction based on a detection result of the sheet top face detecting sensor S1, it is possible to keep a certain uppermost face of sheets stacked on the stacking tray 515.

Operation for detecting the top face of sheets is to repeat operation for moving the stacking tray 515 up from below, where a state in which the sheet stacked on the stacking tray or the top face of the stacking tray 515 interrupts the optical axis of the sheet top face detecting sensor S1 is a home position (HP), moving down until the optical axis of the sheet top face detecting sensor S1 is exposed after stacking the sheet, and subsequently, moving up to a position in which the optical axis is interrupted again. For example, when the sheet is curled upward, since the sheet top face detecting sensor S1 detects the curl portion of the sheet to determine that the uppermost face of the sheet is high, the stacking tray 515 is once moved down until the optical axis of the sheet top face detecting sensor S1 appears, and is moved up until the optical axis is interrupted again. By the moving-up operation, the upward curl of the stacked sheet is resolved, and it is possible to move the stacking tray 515 up to an appropriate paper face height. By this means, it is possible to align the sheet without an aligning member 519 described later performing a missed swing.

Figure 4:
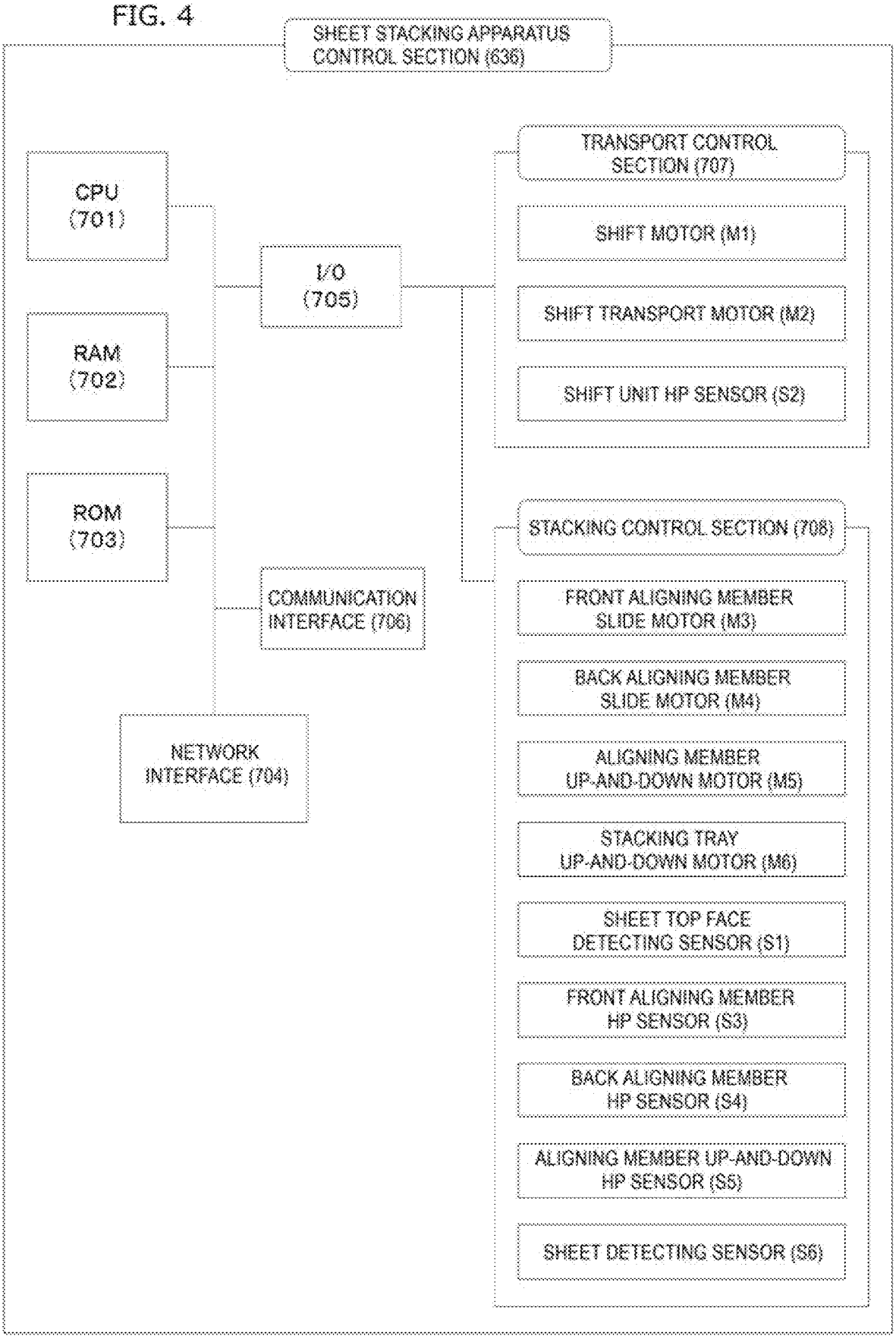
FIG. 4 is a block diagram of the sheet stacking apparatus.

Next, the sheet stacking apparatus control section 636 for controlling the sheet stacking apparatus 500 will be described based on FIG. 4. FIG. 4 shows one example of the control configuration, and is not limited thereto. The section 636 may be provided in the apparatus main body 100 integrally with the CPU circuit section 630 so as to control the sheet stacking apparatus 500 from the apparatus main body 100 side.

The sheet stacking apparatus control section 636 is comprised of a CPU 701, RAM 702, ROM 703, I/O 705, network interface 704, communication interface 706 and the like. The I/O 705 manages a transport control section 707, and stacking control section 708. The transport control section 707 is provided with a shift motor M1 for shifting the shift unit 400, shift transport motor M2 for transporting a sheet inside the shift unit 400, and shift unit HP sensor S2. Further, the stacking control section 708 is provided with a front aligning member slide motor M3, back aligning member slide motor M4, aligning member up-and-down motor M5, and stacking tray up-and-down motor M6. Then, the transport control section 707 and stacking control section 708 detect positions serving as respective reference with various sensors S1 to S6, and are controlled based on the detection results.

Figure 5:
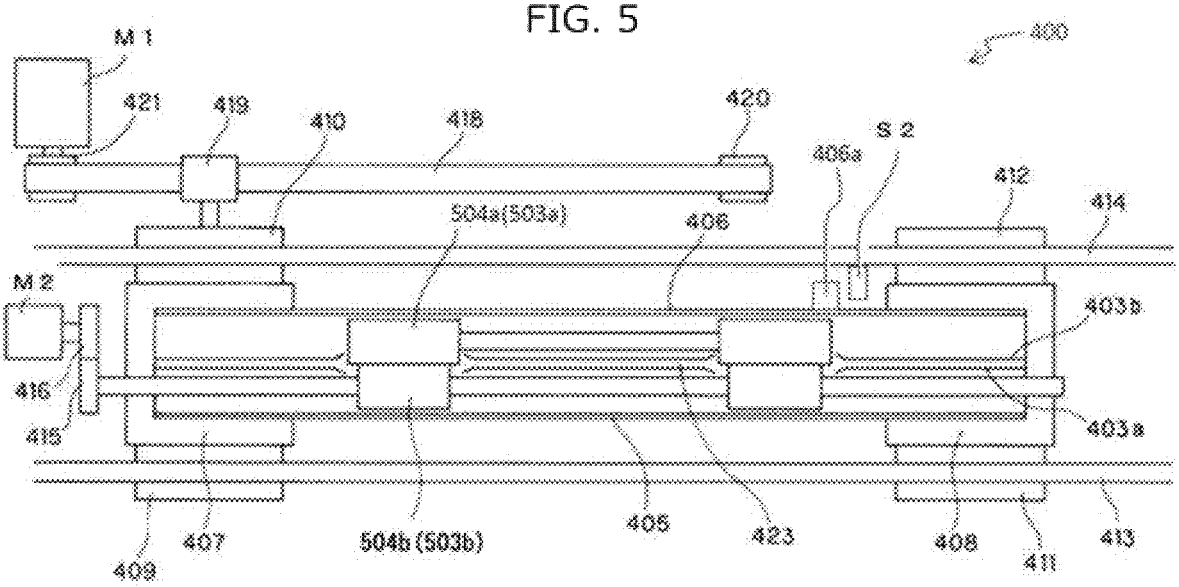
FIG. 5 is a view obtained by viewing a shift unit from the downstream side in a transport direction.

Next, the shift unit 400 that is the sheet shift means provided in the sheet stacking apparatus 500 will be described based on FIG. 5. FIG. 5 is a view obtained by viewing the shift unit 400 from the downstream side in the transport direction of the sheet. In the shift unit 400, transport guides 403*a*, 403*b* form a transport path 423. Further, the unit 400 is configured to be able to transport in a state in which transport roller pairs 503*a*, 503*b*, 504*a*, 504*b* (see FIG. 3) nip the sheet. The transport roller pairs 503, 504 are connected to the shift transport motor M2 via gears 415, 416, respectively, and are configured to be forward/backward rotatable corresponding to rotation of the shift transport motor M2. The transport roller pairs 503, 504 and transport guides 403*a*, 403*b* are supported by frames 405, 406, 407, 408. Further, bearings 409, 410, 411, 412 fixed to the frames 405, 406, 407, 408 are configured to be able to shift along guides 413, 414. Further, the frames 405, 406, 407, 408 are connected to a timing belt 418 by a fix plate 419. The fix plate 419 is configured to be able to shift by the shift motor M1 and pulleys 420, 421 via the timing belt 418. A home position of the shift unit 400 is determined by detecting a flag portion 406*a* inside the frame 406 by a shift unit UP sensor S2 attached to the sheet stacking apparatus 500.

Figure 6A:
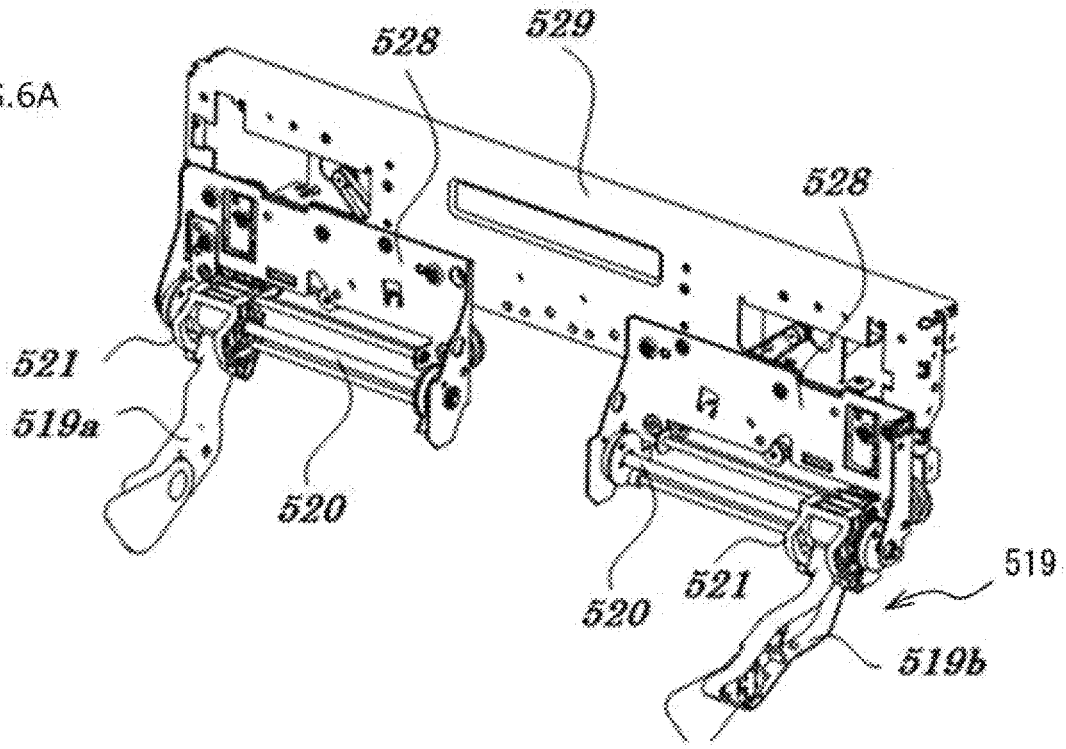
FIGS. 6A and 6B contain perspective views illustrating a configuration of aligning members.
Figure 6B:
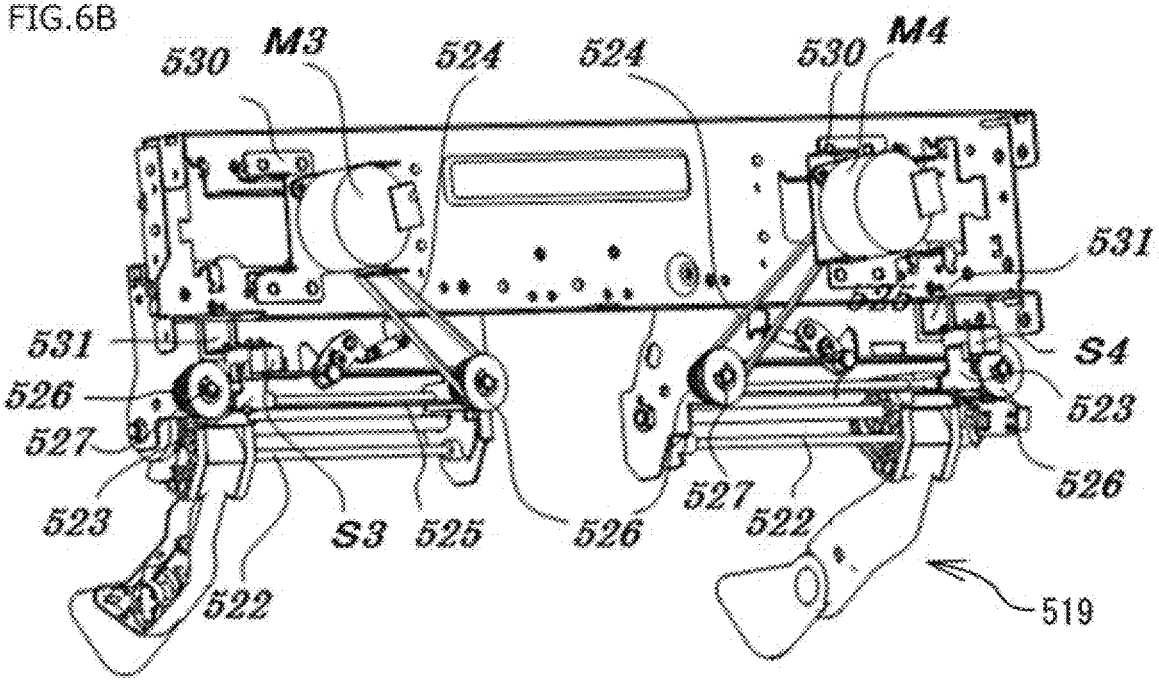

Next, basic operation and configuration of the aligning member 519 provided in the aligning section 517 will be described. As shown in FIG. 11, the aligning member 519 slides in the back-side (left in the figure) that is the rear side of the sheet stacking apparatus 500 and front-side (right in the figure) that is the operation side direction. As shown in FIGS. 6A and 6B, the aligning member 519 is supported by a first aligning spindle 520. Further, the aligning member 519 is guided on the external side by a slide member 521, and follows front-back shifts of the slide member 521. In the following description, viewing the apparatus of the present invention in the direction shown in FIG. 3, the front side in the depth direction is expressed as "front", and the back side is expressed as "back". As the aligning member 519, the slide member 521 is supported by the first aligning spindle 520 as the rotation center, and is supported by a second aligning spindle 522 as a rotation stopper. Then, a second slide drive transfer belt 525 is nipped by the slide member 521 and slide position detecting member 523, and these three parts are coupled with screws. The opposite ends of the second slide drive transfer belt 525 are supported by slide drive transfer pulleys 526. Further, the slide drive transfer pulley 526 is a stepped pulley, and also engages in the first slide drive transfer belt 524, and the first slide drive transfer belt 524 engages in a pulley portion of the front aligning member slide motor M3. In other words, drive of the front aligning member slide motor M3 is transferred to the aligning member 519 via the first slide drive transfer belt 524, slide drive transfer pulley 526, second slide drive transfer belt 525, and slide member 521, and the aligning member 519 shifts between the front side and the back side, while being guided by the first aligning spindle 520. Further, the slide drive transfer pulley 526 is supported by a pulley spindle 527, and the pulley spindle 527 is caulking-coupled to a pulley fulcrum 528. Opposite ends of the first aligning spindle 520 and second aligning spindle 522 are fixed to the pulley fulcrum 528 with E rings. The aligning member 519, pulley fulcrum 528 and the like are made a unit, and are attached to an upper stay 529. Further, the front aligning member slide motor M3 is attached to the upper stay 529 together with a slide motor fulcrum 530. Furthermore, also on the back side, a unit of the aligning member 519, pulley fulcrum 528 and the like, back aligning member slide motor M4 and the like exist, and as on the front side, are attached to the upper stay 529. A front aligning member HP sensor S3 for detecting a position of the front aligning member 519*b* is attached to the upper stay 529 together with an aligning position detecting fulcrum 531. Similarly, a back aligning member HP sensor S4 and aligning position detecting fulcrum 531 are also attached to the upper stay 529. The back aligning member 519*a* and front aligning member 519*b* form a pair, and thereby slide in the sheet width direction crossing the discharge direction of the sheet to perform alignment of the sheet.

Figure 7A:
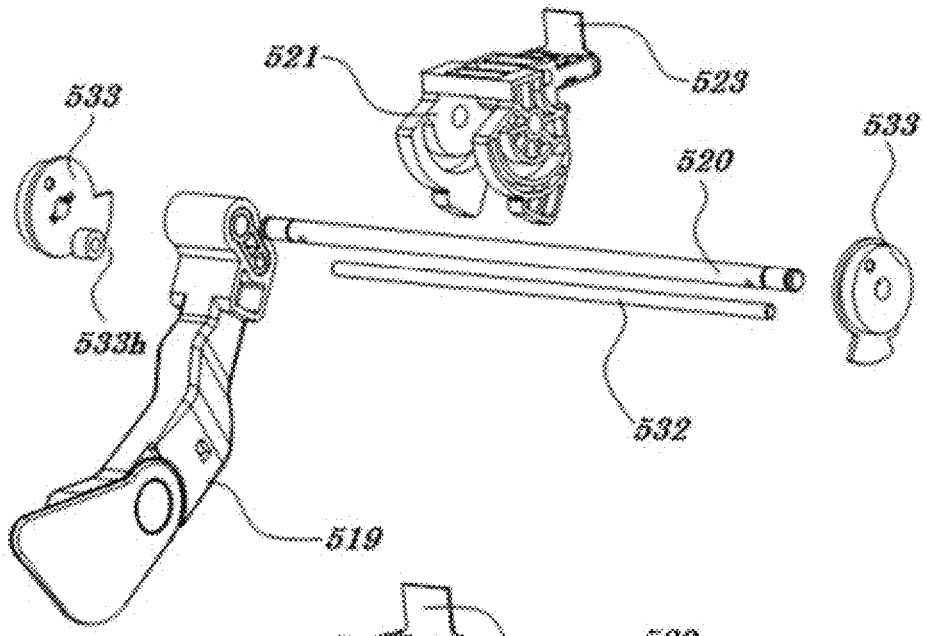
FIGS. 7A to 7C contain perspective views illustrating up-and-down operation of the aligning member.
Figure 7B:
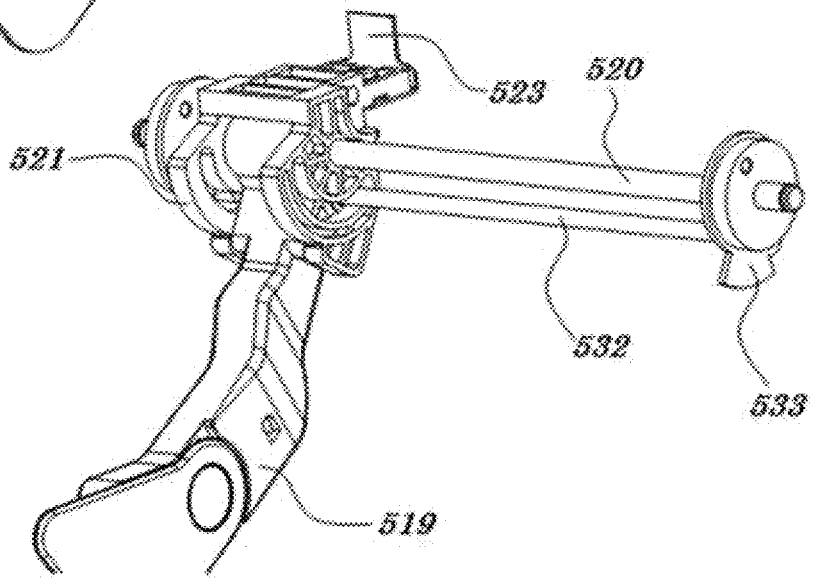
Figure 7C:
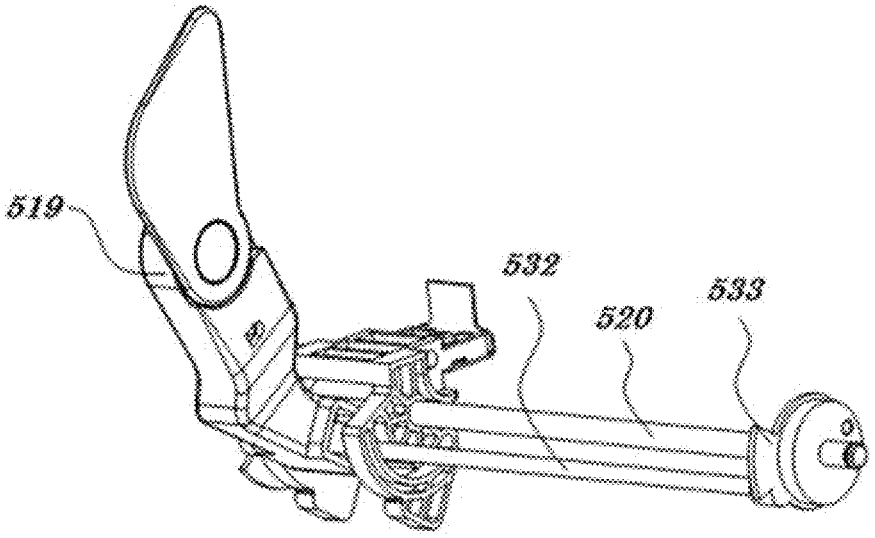

Next, up-and-down operation and up-and-down mechanism of the aligning member 519 will be described, based on FIGS. 7A to 8C. As described previously, the aligning member 519 is supported by the first aligning spindle 520, and further, as shown in FIGS. 7A to 7C, engages in a third aligning spindle 532 as a rotation stopper. Opposite ends of the third aligning spindle 532 are fitted into hole portions 533*h* of the aligning member up-and-down pulley 533, the spindle 532 is thereby supported, and as the aligning member 519, the aligning member up-and-down pulley 533 is also supported by the first aligning spindle 520. The first aligning spindle 520, aligning member up-and-down pulley 533-1 and aligning member up-and-down pulley 533-2 are engaged by parallel pins, and therefore, rotation of the up-and-down pulley 533-1 synchronizes with rotation of the aligning member up-and-down pulley 533-2. When the up-and-down pulleys 533-1, 533-2 rotate, since the third aligning spindle 532 also rotates and shifts around the first aligning spindle 520 as the center, the engaged aligning member 519 also rotates and ascends (state of FIG. 7C).

Figure 8A:
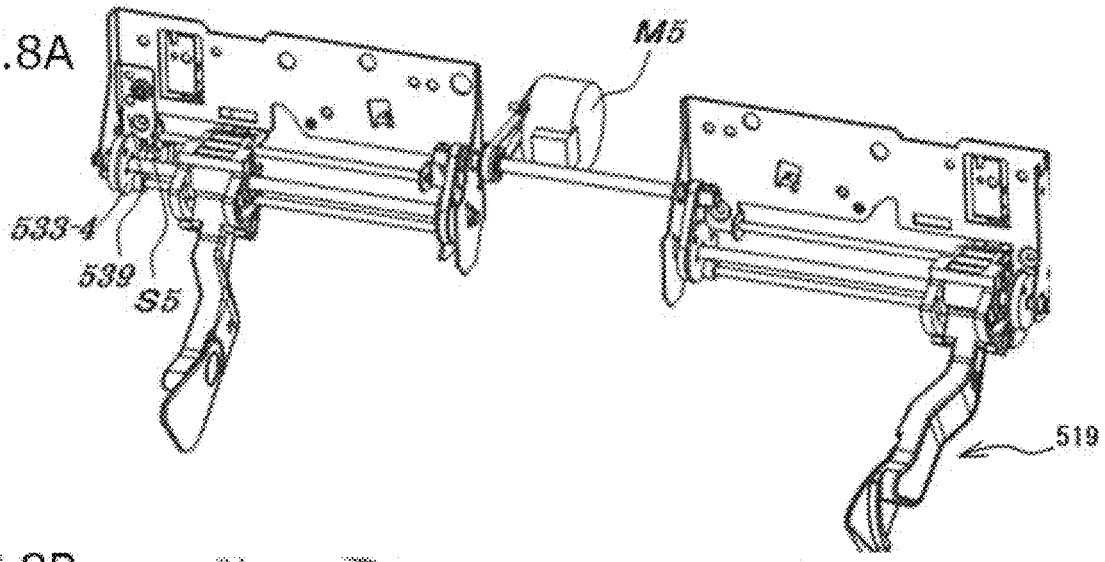
FIGS. 8A to 8C contain perspective views illustrating up-and down operation of the aligning member.
Figure 8B:
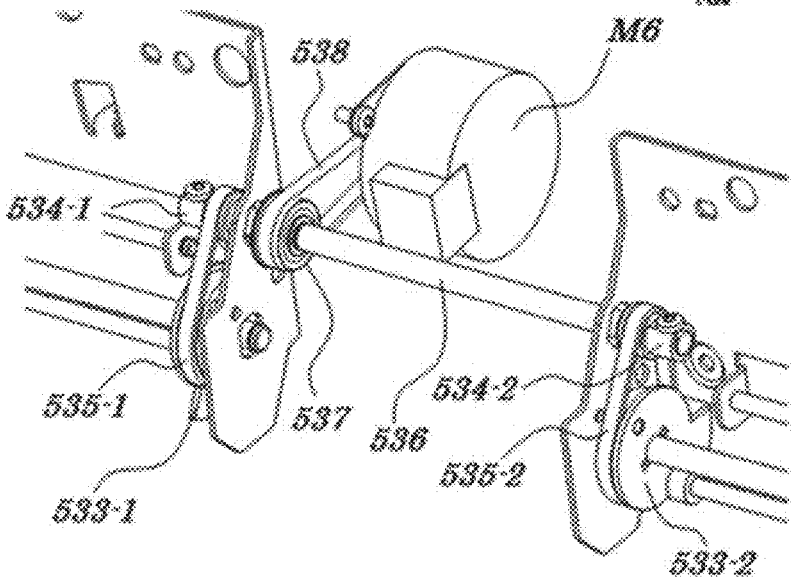
Figure 8C:
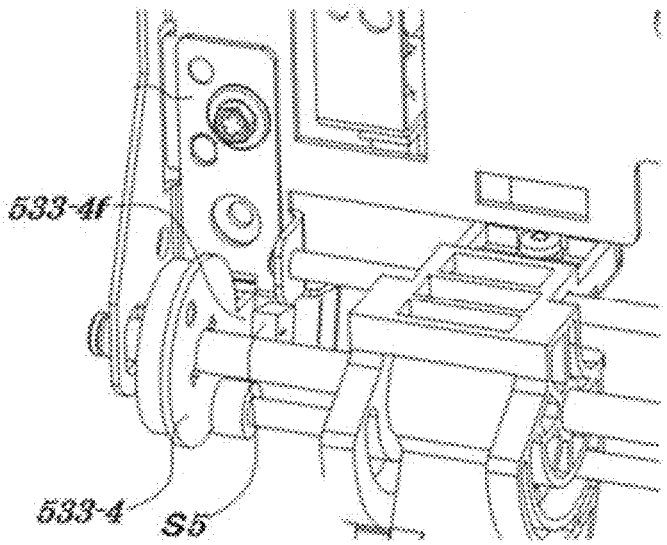

Further, as shown in FIGS. 8A to 8C, rotation drive of the aligning member up-and-down pulley 533-1 is transferred from the second up-and-down pulley 534-1 via the drive transfer belt 535-1. The second up-and-down pulleys 534-1, 534-2 are attached to an up-and-down transfer shaft 536 by D cut both at the front and back, and therefore, rotation of the up-and-down transfer shaft 536 synchronizes with rotation of the second up-and-down pulleys 534-1, 534-2. Further, since a third up-and-down pulley 537 attached to the center portion of the up-and-down transfer shaft 536 is also engaged by a parallel pin, and therefore, rotation of the third up-and-down pulley 537 also synchronizes with rotation of the up-and-down transfer shaft 536. In other words, the rotations of the second up-and-down pulleys 534, up-and-down transfer shaft 536 and third up-and-down pulley 537 are synchronized. Drive of the aligning member up-and-down motor M5 is transferred to the third up-and-down pulley 537 via the drive transfer belt 538, and is further transferred to the up-and-down transfer shaft 536, second up-and-down pulley 534, drive transfer belt 535, aligning member up-and-down pulley 533, third aligning spindle 532, and the aligning member 519. The drive of the aligning member up-and-down motor M5 is thus transferred to the aligning member 519 to perform up-and-down operation of the aligning member 519. The second up-and-down pulley 534-1 transfers drive to the aligning member up-and-down pulley 533-1 on the back side, the second up-and-down pulley 534-2 transfers drive to the aligning member up-and-down pulley 533-2 on the front side, and the drive is thus transferred to move up and down a pair of aligning members on the front side and back side. When the aligning member up-and-down pulley 533-1 on the back side rotates, the aligning member up-and-down pulley 533-4 further on the back side is also driven. At this point, a flag portion 533-4*f* portion provided in the aligning member up-and-down pulley 533-4 switches, to ON/OFF, an aligning member up-and-down HP sensor S5 for detecting an up-and-down position of the aligning member 519, and the up-and-down position of the aligning member 519 is thereby detected and controlled. In this way, the drive of the aligning member up-and-down motor M5 is transferred to move a pair of aligning members 519 up and down, and while up-and-down (rotation) of a pair of aligning members 519 is synchronized, the rotation and position are controlled.

By the above-mentioned operation, in the sheet width direction crossing the discharge direction of the sheet of the discharge roller pair 510, with respect to the sheet larger than the predetermined size, a pair of aligning members 519 regulates the sheet width direction crossing the sheet discharge direction to stack on the stacking tray 515. After stacking the predetermined number of sheets designated by a user, the aligning member 519 is moved up and down to retract from the aligning position.

Figure 9A:
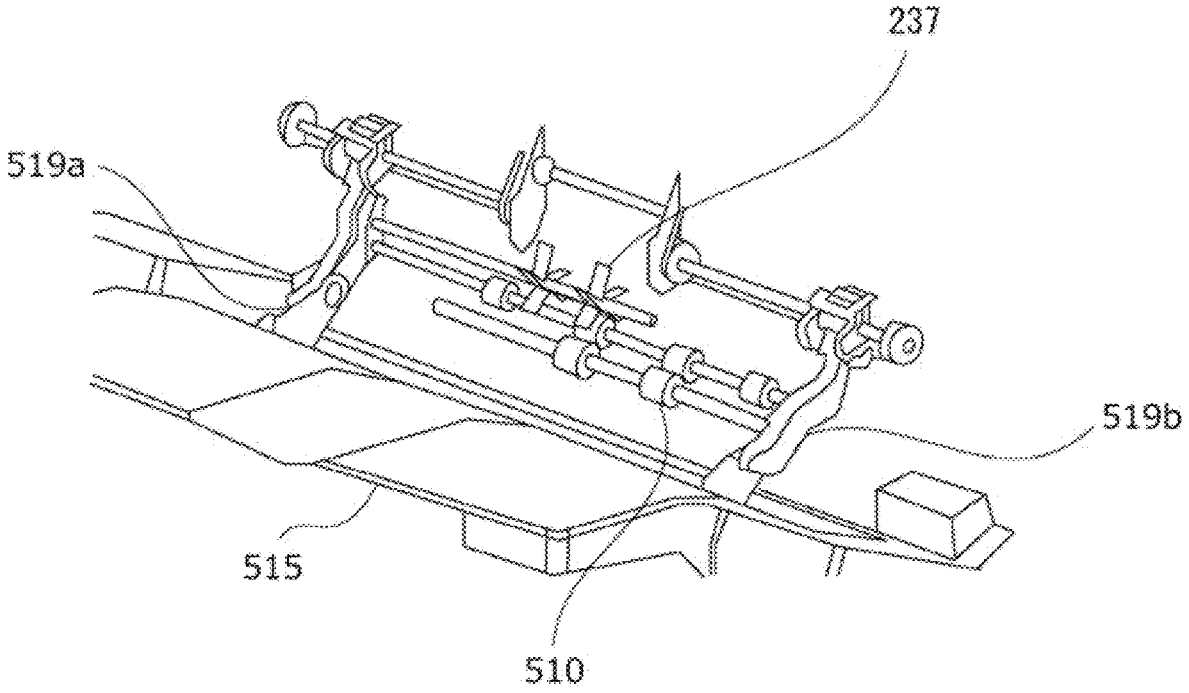
FIGS. 9A and 9B contain configuration views illustrating a configuration in the vicinity of an aligning section 517 in FIG. 3.
Figure 9B:
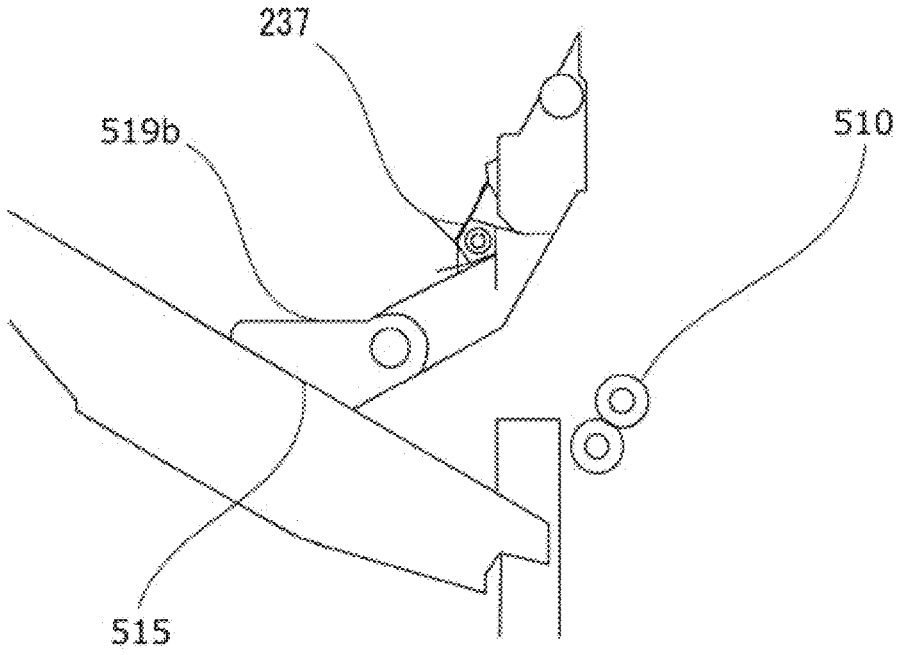

FIGS. 9A and 9B contain configuration views illustrating a configuration in the vicinity of the aligning section 517 in FIG. 3, FIG. 9A is a perspective view obtained by viewing a configuration in the vicinity of the discharge roller 510 from the downstream side in the sheet transport direction, and FIG. 9B is a front view illustrating the configuration in the vicinity of the discharge roller 510.

In FIGS. 9A and 9B, in order to press sheets stacked on the stacking tray 515 from above, a sheet pressing member 237 is disposed in the center portion of the stacking tray 515 in the sheet width direction. The sheet pressing member 237 is supported by a support shaft above the discharge roller 510. Since a pair of aligning members 519*a*, 519*b* are disposed with the sheet pressing member 237 therebetween, a movable range near the center portion of the stacking tray 515 is limited in the width direction crossing the sheet discharge direction. Therefore, with respect to sheets with sizes smaller than the movable range in the width direction crossing the sheet discharge direction, it is not possible to bring the aligning members 519*a*, 519*b* into contact with the sheet. In other words, it is not possible to perform alignment operation on sheets smaller than the above-mentioned movable range.

Figure 10A:
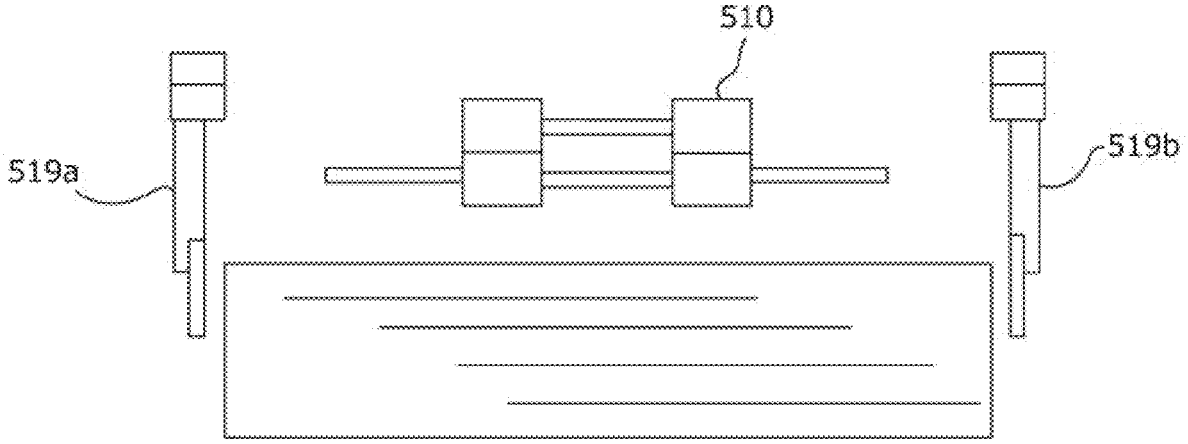
FIGS. 10A to 10C contain side elevational views, viewed from the downstream side in the transport direction of sheets, illustrating a position relationship between the aligning members 519*a*, 519*b* and sheets stacked on a stacking tray 515.
Figure 10B:
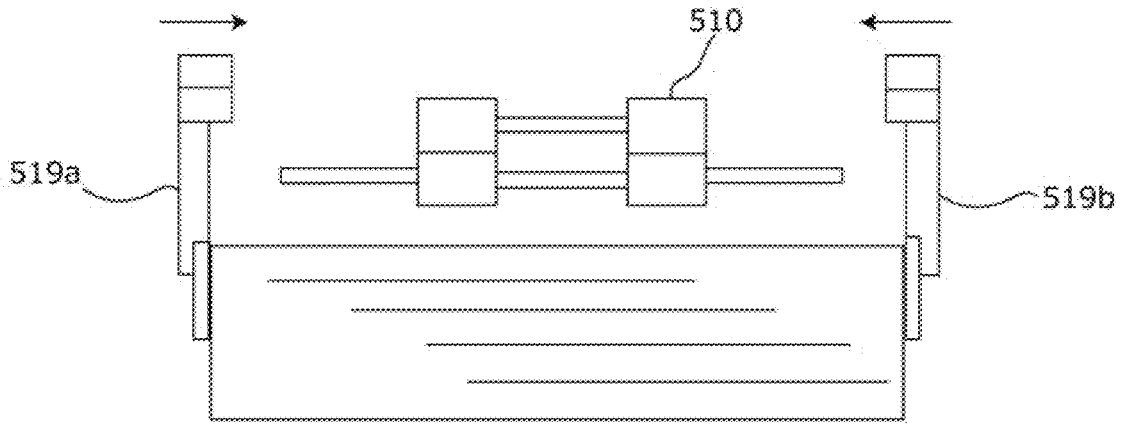
Figure 10C:
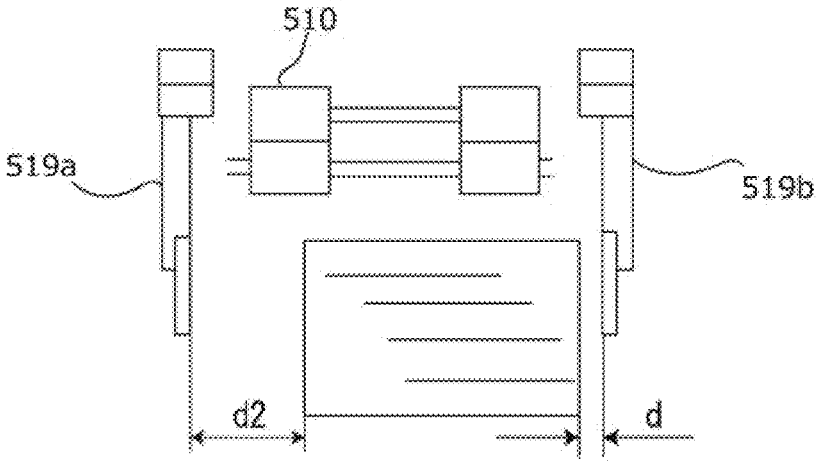

FIGS. 10A to 10C contain side elevational views, viewed from the downstream side in the transport direction of the sheet, illustrating a position relationship between the aligning members 519*a*, 519*b* and sheets stacked on the stacking tray 515.

In FIGS. 10A to 10C, in the case of discharging sheets with sizes in the sheet width direction capable of being aligned by the aligning members 519*a*, 519*b*, as shown in FIG. 10A, the aligning members 519*a*, 519*b* wait in a state of being spaced a predetermined distance away from aligning positions, and when the sheet is discharged from the discharge roller 510, as shown in FIG. 10B, slide in the arrow direction to align the sheet. At this point, there are a case of sliding both of the aligning members 519*a*, 519*b*, and another case of sliding one of the aligning members 519*a*, 519*b* to strike the side by the other one, and thereby aligning, and the method is varied corresponding to stacking conditions of the sheet.

On the other hand, with respect to sheets with sizes in the sheet width direction smaller than the movable range of the aligning members 519*a*, 519*b*, in discharging the sheet with the discharge roller 510, as shown in FIG. 10C, the aligning members 519*a*, 519*b* are in positions where the movable range is the narrowest width, and the sheet to discharge with the discharge roller 510 is discharged to come near, so that one of sides of the sheet in the sheet width direction is discharged toward an inward position by a predetermined distance d in the sheet width direction from a position (hereinafter, referred to as guide position) of the back aligning member 519*a* or front aligning member 519*b* (the front aligning member 519*b* in this Embodiment). Therefore, the shift unit 400 beforehand shifts the sheet in the sheet width direction before discharging the sheet, so that one side in the sheet width direction of the sheet is in the inward position by the predetermined distance d from the front aligning member 519*b*.

By this means, in the case where the discharged sheet leaving the discharge roller 510 is displaced toward the front aligning member 519*b* in the direction for reducing the predetermined distance d, by an effect of an layer of air generated between the top face of the stacking tray 515 and the sheet or between the sheet and a sheet already stacked on the stacking tray 515, the end edge of the sheet in the sheet width direction comes into contact with the front aligning member 519*b*, and the displacement is regulated. In other words, in the discharged sheet, a displacement amount in the one-side direction is regulated by the front aligning member 519*b*, and it is possible to improve alignment characteristics on the stacking tray 515.

In addition, the reason why the sheet is discharged to the inward position by the predetermined distance d from the guide position of the front aligning member 519*b* is that when the sheet under discharge hits the front aligning member 519*b*, there is the risk that the front aligning member rubs and sustains damage by the sheet, and that the alignment characteristics are impaired rather by a reaction caused by the sheet under discharge hitting the front aligning member 519*b*. The predetermined distance d is preferably set at about 5±2 mm, and as shown in FIG. 10C, is a distance narrower than a distance d2 between the back aligning member 519*a* and the other end edge of the sheet in the sheet width direction.

Figure 11A:
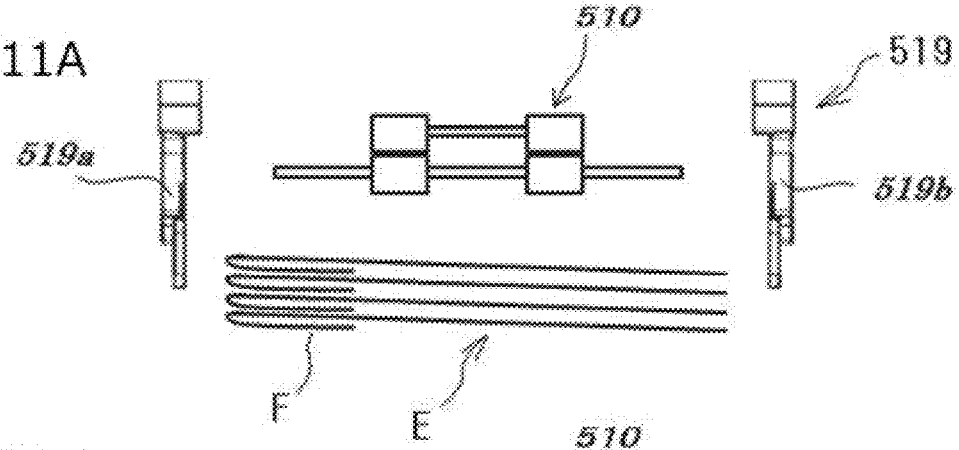
FIGS. 11A to 11C contain views illustrating regulating operation of the aligning member.
Figure 11B:
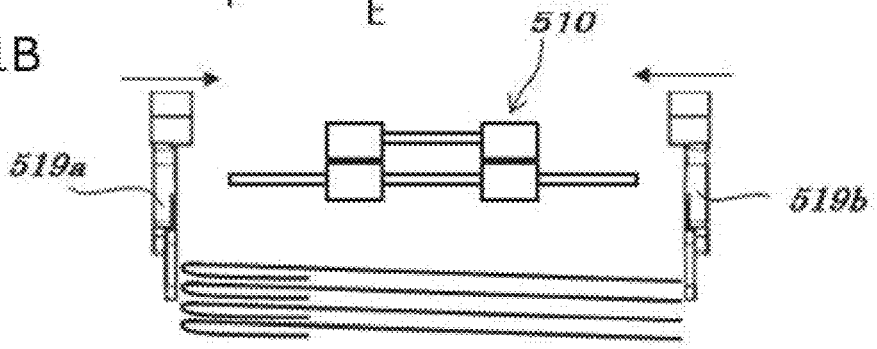
Figure 11C:
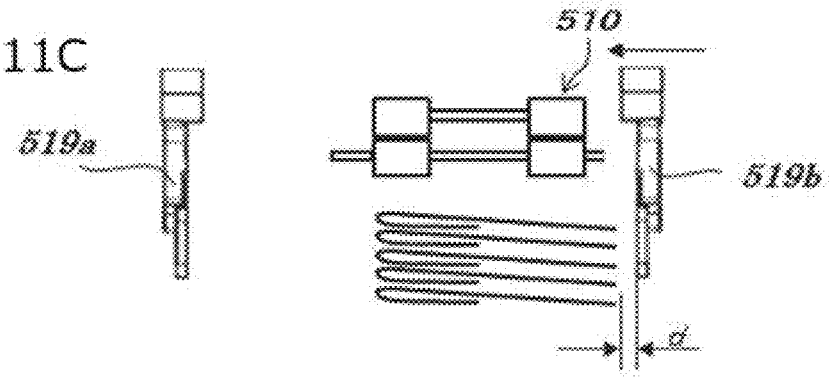

In addition, the movable range of a pair of aligning members 519 is limited in the sheet width direction crossing the sheet discharge direction. Therefore, also with respect to sheets (envelopes) with sizes smaller than the movable range in sheet width direction crossing the discharge direction of the sheet, as in the above-mentioned example of the sheet, since it is not possible to bring the aligning member 519 into contact with the envelope, it is not possible to align the width direction of the envelope. FIGS. 11A to 11C illustrate position relationships between the aligning members 519 and envelopes E stacked on the stacking tray 515. As shown in FIG. 11A, in the case of discharging envelopes E with a width capable of being aligned by the back aligning member 519*a* and front aligning member 519*b*, a pair of aligning members 519 waits in a state of being spaced a predetermined distance away from the aligning position, and when the envelope E is discharged from the discharge roller 510, as shown in FIG. 11B, the back aligning member 519*a* and front aligning member 519*b* slide in arrow directions and align the envelope E. On the other hand, with respect to the envelope E with the size, in the sheet width direction crossing the discharge direction of the envelope E, smaller than the movable range of the aligning members 519, as shown in FIG. 11C, in discharging the envelope E with the discharge roller 510, the front aligning member 519*b* is shifted to a regulation position for regulating one side of the envelope E discharged with the discharge roller 510. At this point, the sheet stacking apparatus control section 636 controls so that the front aligning member 519*b* on the side opposite the flap portion F having the thickness of the envelope E stacked on the stacking tray 515 is shifted to the position for regulating the envelope E. Further, in order to regulate the envelope E by the front aligning member 519*b*, the shift unit 400 shifts the envelope E to a position spaced a predetermined distance away from the front aligning member 519*b*, and by shifting the shift unit 400 and one or both of a pair of aligning members 519, a relative position relationship between the envelope E and a pair of aligning members 519 is varied to regulate one side of the envelope E. With respect to the direction of the flap portion F of the envelope E, although there are many cases that the direction is beforehand determined in the apparatus main body 100, it is also possible to set by the operation section 601, and in this case, the back aligning member 519*a* on the side opposite the set flap portion F side is shifted to the position to regulate. By this means, also with respect to the envelope E with the size smaller than the movable range of a pair of aligning members 519 in the width direction crossing the discharge direction of the envelope E, it is possible to regulate stack displacement in one direction in the sheet width direction by the aligning member 519, and it is possible to improve stacking characteristics of envelopes more than conventional cases. Further, conventionally, in order to prevent an envelope from falling by an increased height difference in the sheet face, limitations have been imposed on the number of sheets to stack. However, even when stacked envelopes are inclined in the horizontal direction by a height difference caused by a rise on the flap portion F side, it is possible to support by a pair of aligning members 519, and it is thereby possible to prevent the envelope from falling. By this means, it is possible to increase the stacking capacity of the envelope to stack on the stacking tray 515.

Figure 12A:
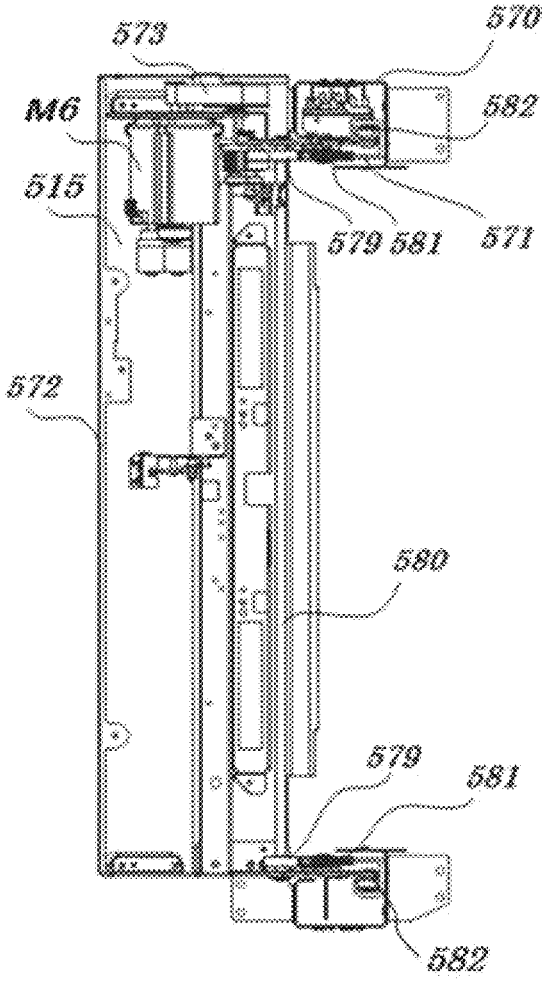
FIGS. 12A and 12B contain perspective views illustrating a configuration of up-and-down operation of the stacking tray.
Figure 12B:
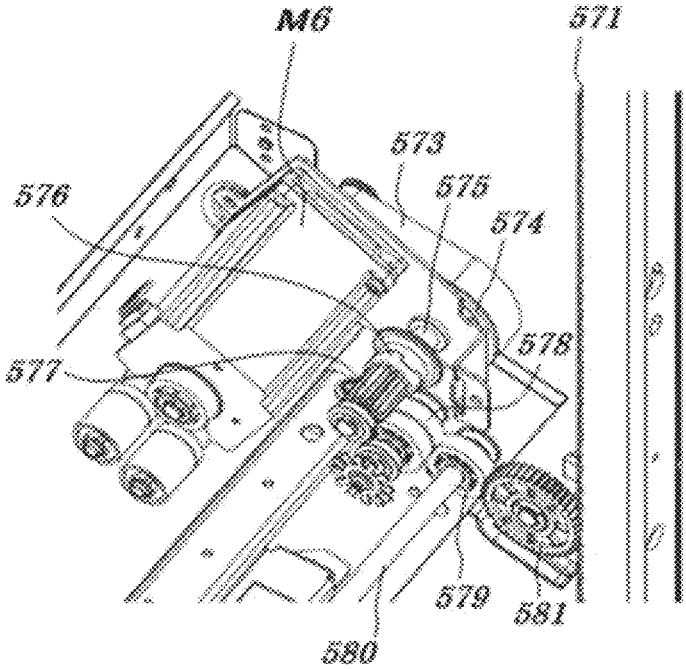

Next, a configuration of the above-mentioned stacking tray 515 will be described based on FIGS. 12A and 12B. The stacking tray 515 has the stacking tray up-and-down motor M6 capable of moving up and down vertically, and is attached to a rack 571 attached vertically with respect to a frame 570 of the sheet stacking apparatus 500. As shown in FIGS. 12A and 12B, in the configuration of the stacking tray 515, the stacking tray up-and-down motor M6 that is a stepping motor is attached to a tray base plate 572, and a pulley press-fitted onto a shaft of the stacking tray up-and-down motor M6 transfers drive to a pulley 574 by a timing belt 573. A shaft 575 connected to the pulley 574 by a parallel pin transfers the drive to a ratchet 576 connected to the shaft 575 similarly by a parallel pin, and the ratchet 576 biases by a wing of an idler gear 577 (not shown). The idler gear 577 is connected to a gear 578 to transfer the drive, and the gear 578 is connected to a gear 579 to transfer the drive. Another gear 579 is also attached via a shaft 580 so as to drive the stacking tray 515 at both the front and back, and these two gears are coupled to a rack 571 via gears 581. The stacking tray 515 is fixed by two rollers 582 on one side being held in the rack 571 also serving as a roller receiver. Further, the stacking tray 515 constitutes a tray unit into which are integrated the above-mentioned stacking tray up-and-down motor M6, idler gear 577, base plate 572 for supporting the motor and gear, sheet support plate (not shown) attached onto the base plate 572 and the like. In this way, the drive of the stacking tray up-and-down motor M6 is transferred, and the stacking tray 515 is thereby capable of moving up and down in the arrow Z direction shown in FIG. 3.

Figure 13A:
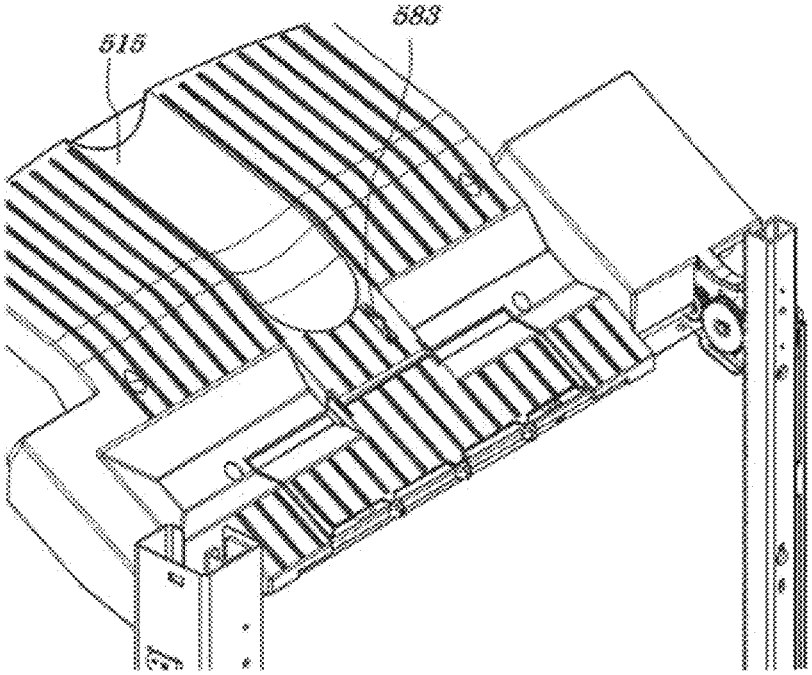
FIGS. 13A to 13C contain perspective views illustrating a configuration of sheet detecting means of the stacking tray.
Figure 13B:
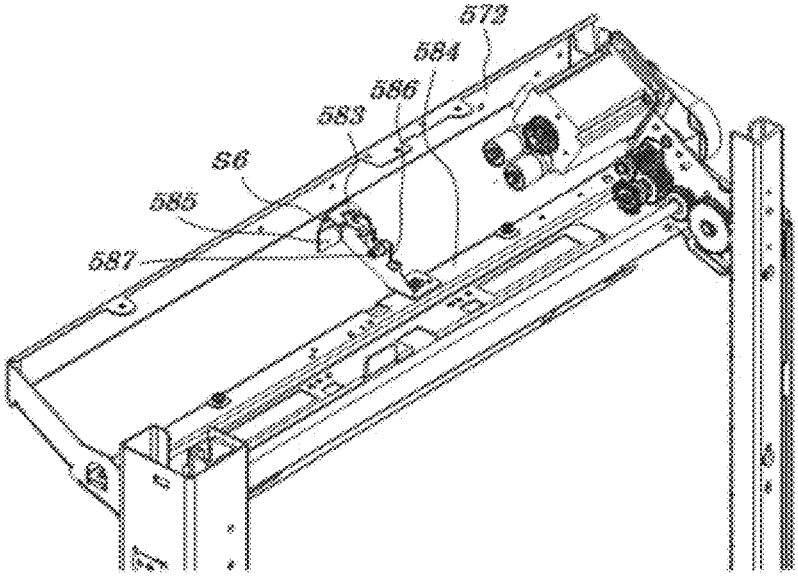
Figure 13C:
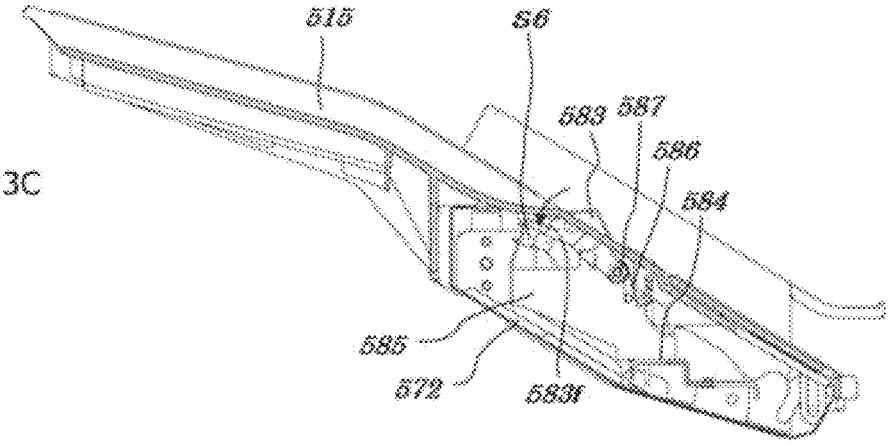

Next, sheet detecting means for detecting the presence or absence of a sheet such as an envelope stacked on the stacking tray 515 will be described based on FIGS. 13A to 13C. As shown in FIGS. 13A to 13C, the stacking tray 515 is provided with a detection flag 583 for detecting the presence or absence of a sheet on the stacking tray 515 so as to perform detection of the presence or absence of the sheet. As shown in FIG. 13B, a flag fulcrum 585 is attached to a tray base stay 584 connected to the tray base plate 572. A flag rotation shaft 587 is joined to the flag fulcrum 585 by swaging, and the detection flag 583 is supported by the flag rotation shaft 587, and is configured to rotate about the flag rotation shaft 587 as the center. Further, the flag fulcrum 585 is provided with the sheet detecting sensor S6 that is turned ON/OFF by rotation of the detection flag 583, the detection flag 583 protrudes against the stacking tray 515, as shown in FIG. 13C, by a helical torsion coil spring 586, and the sheet detecting sensor S6 is biased to a state of OFF (no sheet). Then, when a sheet is stacked on the stacking tray 515, the detection flag 583 rotates in the arrow direction by weight of the sheet, and the sheet detecting sensor S6 is turned ON to detect the presence of the sheet, by a flag portion 583F of the detection flag 583.

Figure 14A:
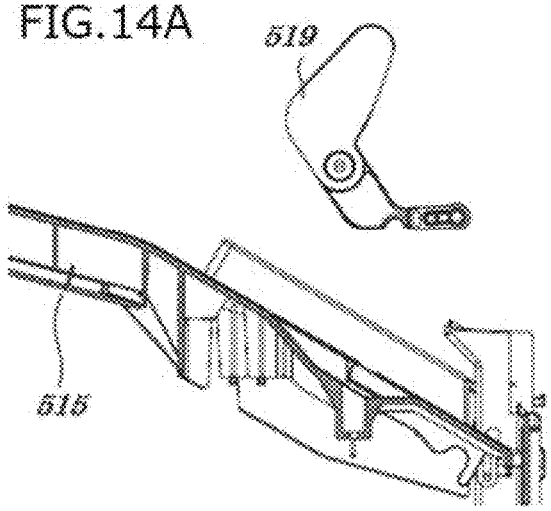
FIGS. 14A to 14D are operation explanatory views of the aligning member in transporting a sheet.
Figure 14B:
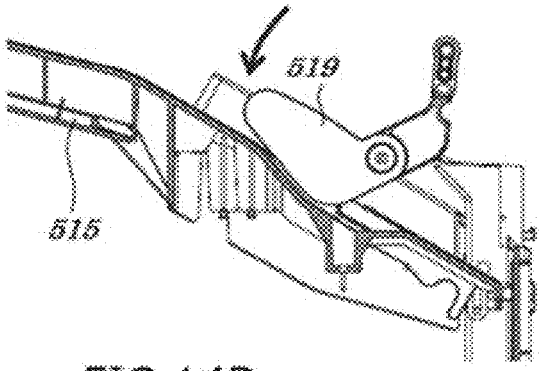
Figure 14C:
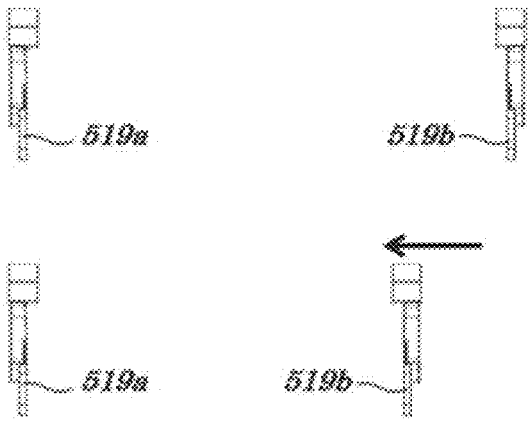
Figure 14D:
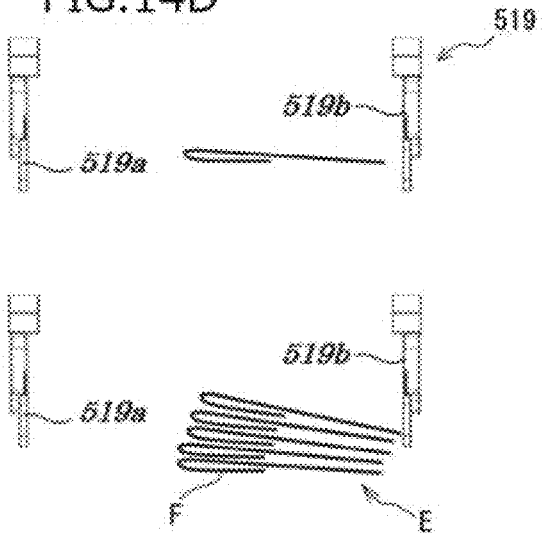
Figure 15:
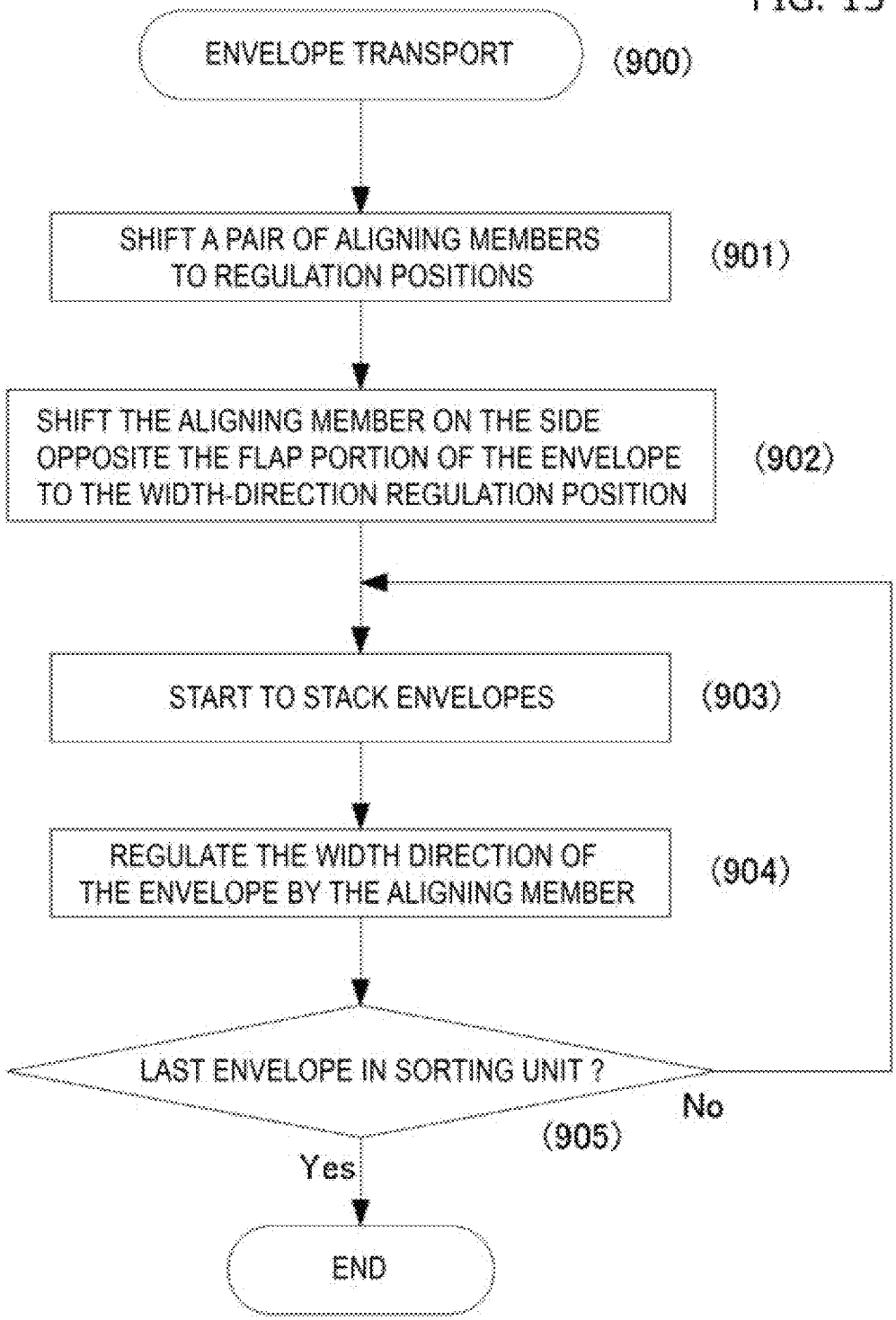
FIG. 15 is a flowchart of the aligning section in transporting a sheet.

Based on FIGS. 14A to 15, described next is operation (FIG. 15 (900)) in stacking envelopes E each having a flap portion F with a fold on the stacking tray 515, as the sheet with the size smaller than the movable range of a pair of aligning members 519 in the sheet width direction crossing the sheet discharge direction of the sheet stacking apparatus 500. First, transport of envelopes E smaller than 148 mm is selected as the type of sheet, the aligning member 519 shifts from a retract position in a height direction shown in FIG. 14A to a regulation position shown in FIG. 14B (FIG. 15 (901)). Next, in the case where the flap portion F of the envelope E is set on the rear side (back side) of the sheet stacking apparatus 500, as shown in FIG. 14C, the front aligning member 519*b* on the side opposite the flap portion F shifts to the regulation position in the sheet width direction, and the envelope E is stacked on the stacking tray 515 (FIG. 15 (902, 903)). Since the envelope E to stack on the stacking tray 515 is regulated by the front aligning member 519*b*, it is possible to regulate stack displacement on the front aligning member 519*b* side, and a plurality of envelopes is stacked on the stacking tray 515, while regulating the last envelope E among the plurality of transported envelopes (FIG. 15 (904, 905)). The front aligning member 519*b* regulates the envelope E stacked on the stacking tray 515, and waits in the regulation until the user removes the envelopes E stacked on the stacking tray 515, in order to prevent the envelope E from falling from the stacking tray 515, in the case where the top face of the envelope E is inclined by a rise of flap portions F of stacked envelopes E.

Figure 16A:
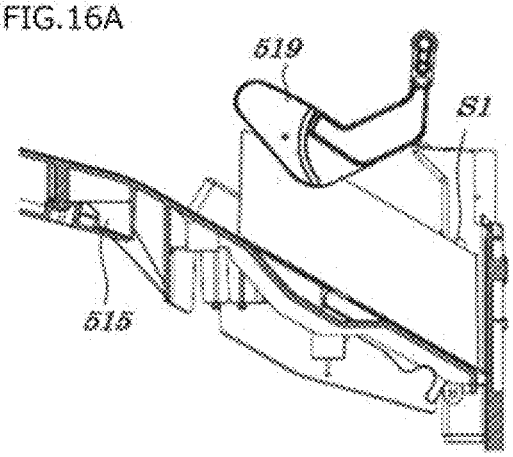
FIGS. 16A to 16E contain operation explanatory views of the aligning section in removing the sheet.
Figure 16B:
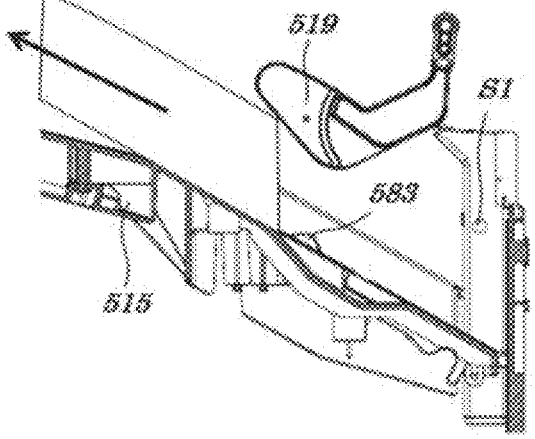
Figure 16C:
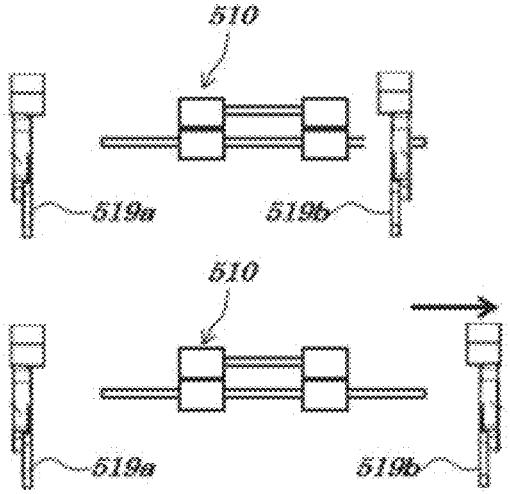
Figure 16D:
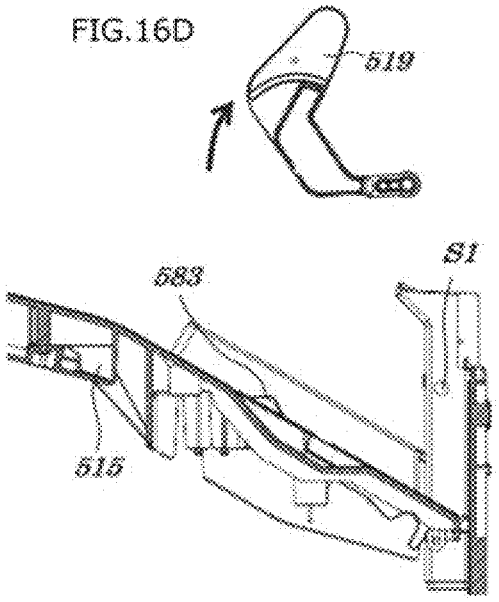
Figure 16E:
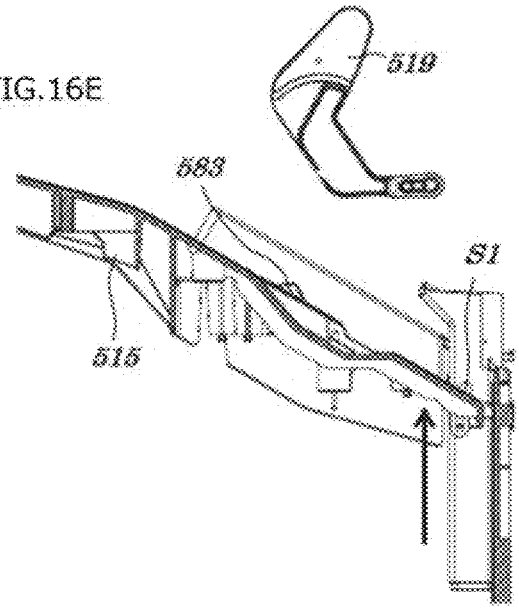
Figure 17A:
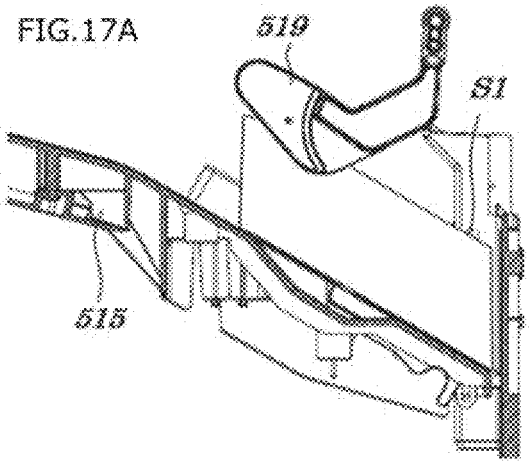
FIGS. 17A to 17C contain operation explanatory views of the aligning section in removing the sheet.
Figure 17B:
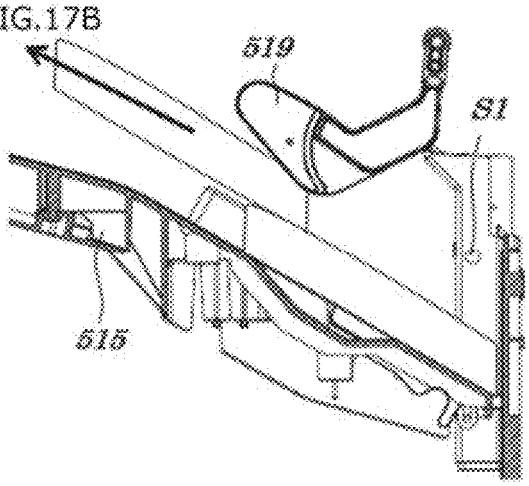
Figure 17C:
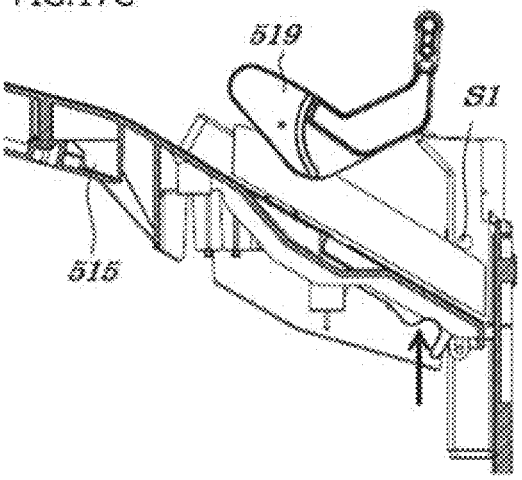
Figure 18:
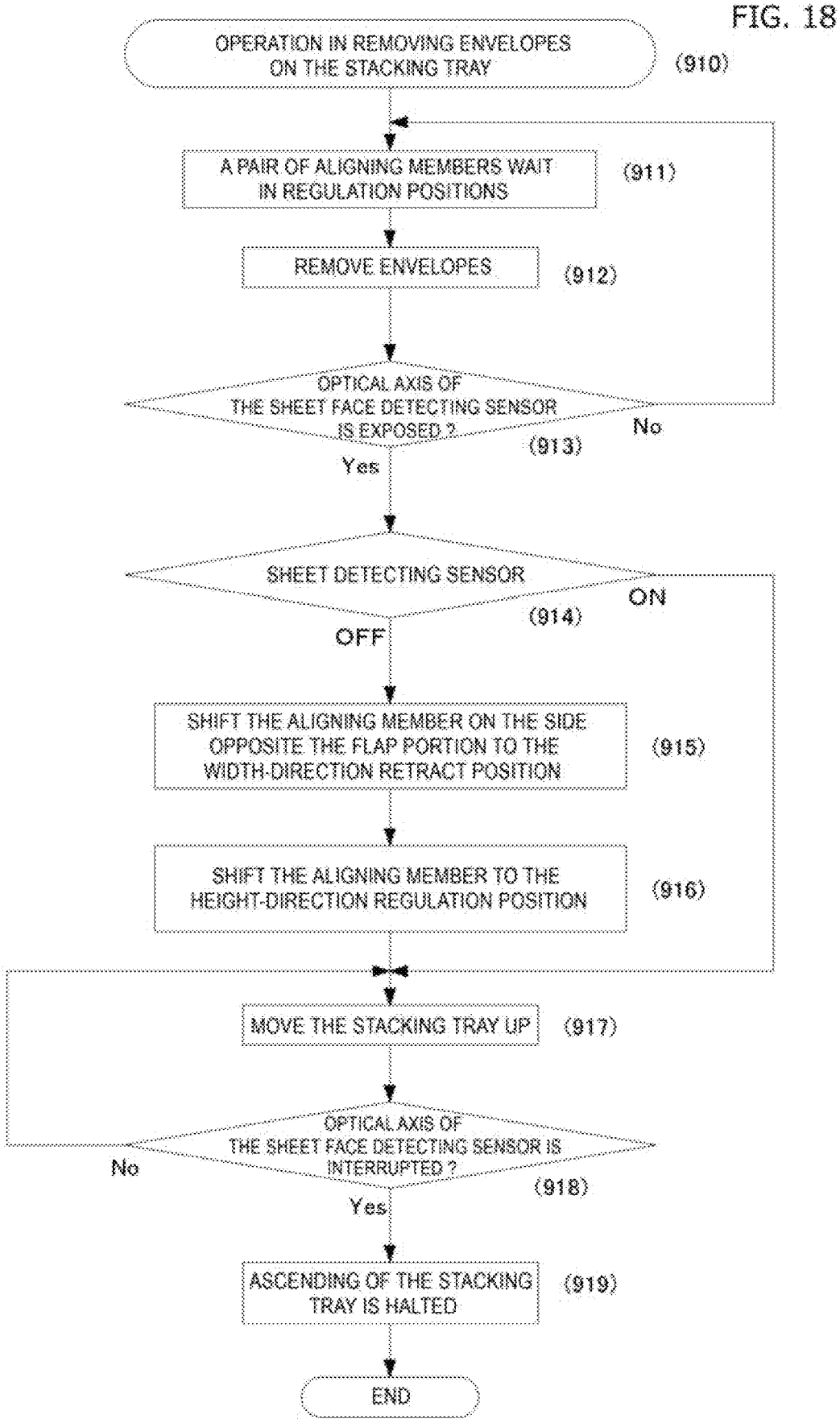
FIG. 18 is a flowchart of the aligning section in removing the sheet.

Based on FIGS. 16A to 18, described next is operation (FIG. 18 (910)) when the user removes envelopes E stacked on the stacking tray 515. As shown in FIG. 16A, until the user removes the envelopes E stacked on the stacking tray 515, a pair of aligning members 519 regulates falling of the envelope in a state of waiting in the regulation position (FIG. 18 (911)). When the envelopes E are removed in this state, as shown in FIG. 16B, the optical axis of the sheet top face detecting sensor S1 is exposed (FIG. 18 (912, 913)). At this point, the sheet detecting sensor S6 is switched from a state of the presence of the sheet (ON) to a state of the absence of the sheet (OFF), and it is determined that the envelope E does not exist on the stacking tray 515 i.e. a state in which all envelopes E on the stacking tray 515 are removed is determined (FIG. 18 (914)). Then, as shown in FIG. 16C, the front aligning member 519*b* first shifting to the regulation position on the side opposite the flap portion F shifts to the retract position in the sheet width direction, and next, the aligning member 519 shifts to the retract position in the height direction as shown in FIG. 16D (FIG. 18 (915, 916)). When the retraction of a pair of aligning members 519 is thus completed, the stacking tray 515 starts to move up, and after moving up to interrupt the optical axis of the sheet top face detecting sensor S1, is halted (FIG. 18 (917-919)). Further, as shown in FIG. 17B, even after removing the envelopes E, in a state in which the sheet detecting sensor S6 is still ON, it is determined that the envelope E is left on the stacking tray 515, and while causing a pair of aligning members 519 to wait in the position to regulate, the stacking tray 515 is moved up to the position for interrupting the optical axis of the sheet top face detecting sensor S1. In this Embodiment, the stacking tray 515 is moved up after retracting a pair of aligning members 519, and the effect is not varied when timing for moving the stacking tray 515 up is the same as the retraction of the aligning member 519 or before the retraction.

Figure 19A:
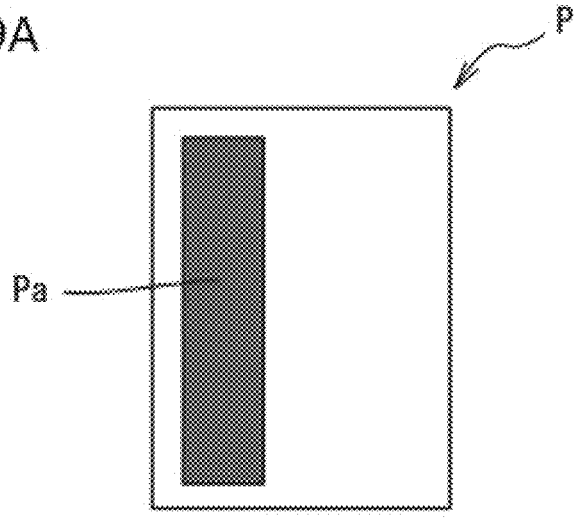
FIGS. 19A to 19C contain explanatory views illustrating operation for regulating a postcard with a print face formed.
Figure 19B:
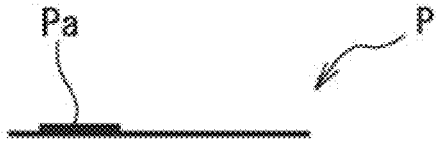
Figure 19C:
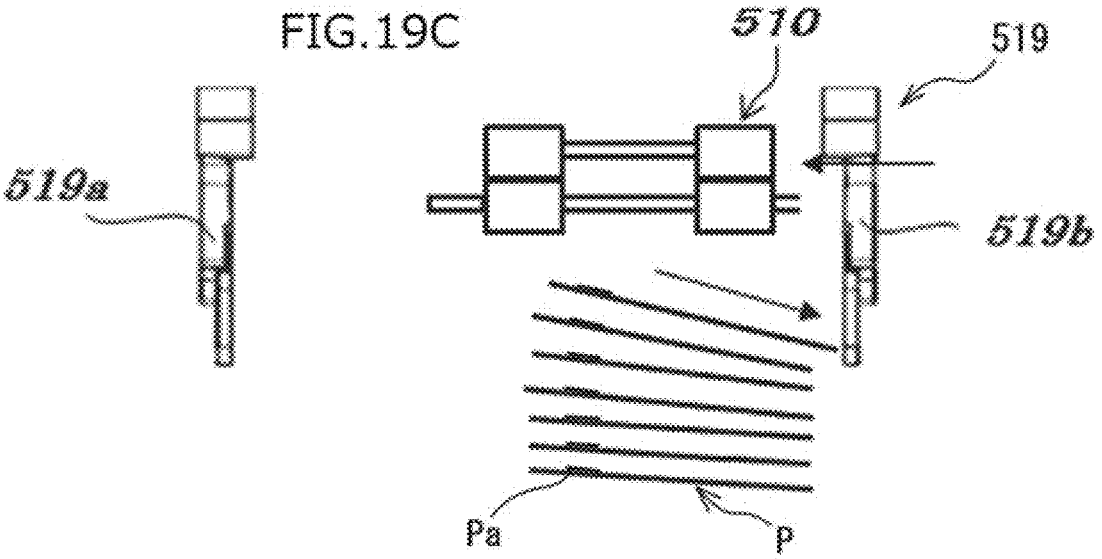
Figure 20:
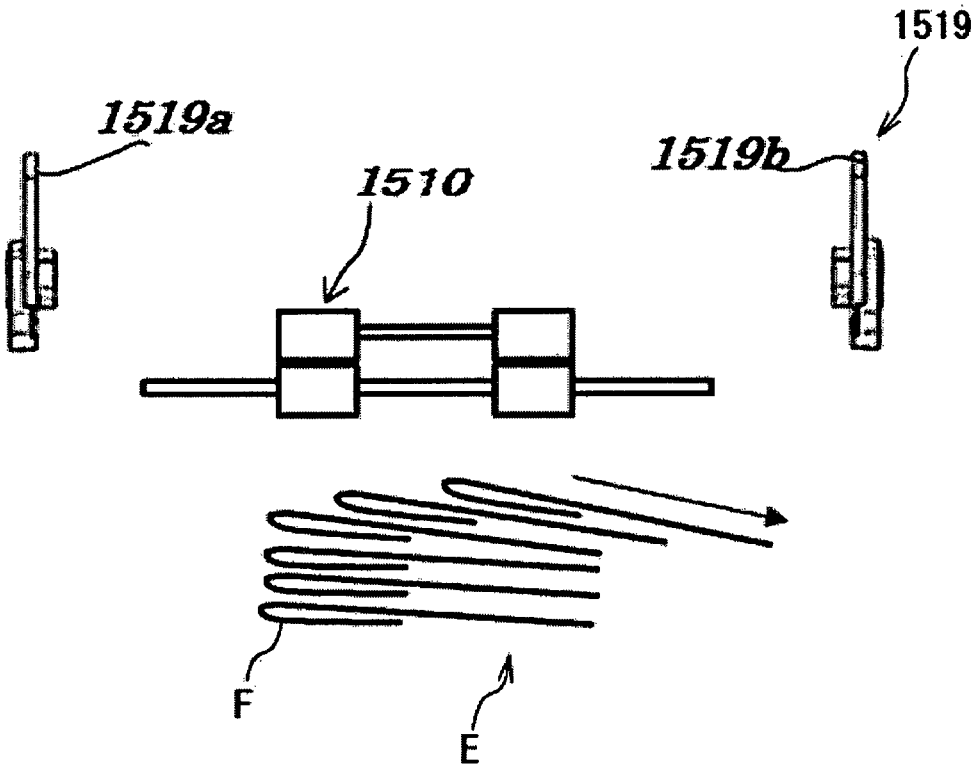
FIG. 20 Prior Art
FIG. 20 is an explanatory views illustrating a state in which a plurality of envelopes each having a flap portion is stacked in a conventional sheet stacking apparatus.

The above-mentioned Embodiment describes the case where the sheet to stack is the envelope having a thick portion caused by a fold of the flap portion, but the sheet is not limited to such an envelope, and as in the envelope described previously, also in sheets with the size in the sheet width direction smaller than the movable range of the aligning member 519, it is possible to obtain appropriate stacking characteristics. For example, also in flat sheets without the flap portion and the like, corresponding to a coating position and amount of toner, ink and the like used in printing, a thick portion occurs in a part of the surface of the sheet by printing, and when a plurality of such sheets is stacked on the stacking tray 515, a height difference occurs. For example, as shown in FIGS. 19A and 19B, in a sheet P such as a postcard, since a print surface Pa of an address and the like is formed in a predetermined position in the sheet width direction crossing the discharge direction of the sheet by the discharge roller 510, deviation occurs in an image range of the sheet P. When such sheets P are stacked, as shown in FIG. 19C, a height difference gradually increases between the portion where the print surface Pa is formed and the surface without printing, and by shifting one (aligning member 519*b*) of a pair of aligning members 519 of the present invention to a regulation position on the side opposite the print surface Pa, it is possible to effectively prevent the sheet from falling.

The invention claimed is:

1. A sheet stacking apparatus comprising:

a stacking section adapted to stack sheets discharged in a predetermined discharge direction from a discharge section;

a shift section adapted to shift a sheet discharged to the stacking section, in a width direction of the sheet crossing the discharge direction;

a pair of aligning sections capable of shifting in the width direction to align end edges in the width direction of the sheet discharged to the stacking section, on a downstream side from the shift section in the discharge direction;

a sheet pressing section provided between the pair of aligning sections to press the sheet to discharge, and a control section adapted to control the aligning sections and the shift section so as to adjust a relative position of the aligning sections and the end edges in the width direction of the sheet discharged, wherein a movable range, in a center portion, of the pair of aligning sections in the width direction is regulated by the sheet pressing section, and in discharging a sheet with a width narrower than the sheet capable of being aligned by the pair of aligning sections and narrower than the movable range in the center portion, to the stacking section, the control section controls the aligning sections and the shift section so that a distance between one of the pair of aligning sections and one of the end edges in the width direction of the sheet is narrower than a distance between the other one of the pair of aligning sections and the other one of the end edges in the width direction of the sheet, and that the one of the pair of the aligning sections regulates a shift of the sheet discharged to the stacking section to one direction in the width direction.

2. The sheet stacking apparatus according to claim 1, wherein the control section controls the aligning sections and the shift section, so that a distance between an aligning section on a front side in the width direction and an end edge on the front side in the width direction of the sheet is narrower than a distance between an aligning section on a back side in the width direction with respect to the stacking section in the pair of aligning sections and an end edge on the back side in the width direction of the sheet, and that in the pair of aligning sections, the aligning section on the front side in the width direction with respect to the stacking section regulates a shift of the sheet discharged to the stacking section to the front side in the width direction.

3. The sheet stacking apparatus according to claim 1, further comprising:

a sheet width acquiring section adapted to acquire a width of the sheet discharged to the stacking section, wherein when the width of the sheet discharged to the stacking section acquired by the sheet width acquiring section is a sheet with a width narrower than the sheet capable of being aligned by the pair of aligning sections, the control section controls the aligning sections and the shift section so that a distance between one of the pair of aligning sections and one of the end edges in the width direction of the sheet is narrower than a distance between the other one of the pair of aligning sections and the other one of the end edges in the width direction of the sheet, and that the one of the pair of the aligning sections regulates a shift of the sheet discharged to the stacking section to one direction in the width direction.

4. An image forming system comprising:

an image forming apparatus adapted to form an image on a sheet; and the sheet stacking apparatus according to claim 1 to stack the sheet discharged from the image forming apparatus.

5. A sheet stacking apparatus comprising:

a stacking section adapted to stack sheets discharged in a predetermined discharge direction from a discharge section;

a shift section adapted to shift a sheet discharged to the stacking section, in a width direction of the sheet crossing the discharge direction;

a pair of aligning sections capable of shifting in the width direction to align end edges in the width direction of the sheet discharged to the stacking section, on a downstream side from the shift section in the discharge direction; and a sheet pressing section provided between the pair of aligning sections to press the sheet to discharge, a control section adapted to control the aligning sections and the shift section so as to adjust a relative position of the aligning sections and the end edges in the width direction of the sheet discharged, wherein a movable range in a center area in the width direction of the pair of aligning sections is regulated by the sheet pressing section, and in discharging a sheet, which has a width small than the movable range in the center area in the width direction of the pair of aligning sections, to the stacking section, when one of the end edges along the discharge direction of the sheet is thicker than the other one of the end edges opposed to the one, in the pair of aligning sections, the control section controls the aligning sections and the shift section so that the aligning section on a side of the other one of the end edges regulates a shift of the sheet discharged to the stacking section to the side of the other one of the end edges.

6. The sheet stacking apparatus according to claim 5, wherein when one of the end edges along the discharge direction of the sheet is thicker than the other one of the end edges opposed to the one, in the pair of aligning sections, the control section controls the aligning sections and the shift section so that a distance between the aligning section on the other side and the other one of the end edges of the sheet is narrower than a distance between one of the pair of aligning sections and the one of the end edges of the sheet, and that in the pair of aligning sections, the aligning section on the other one of the end edges side regulates a shift of the sheet discharged to the stacking section to the other one of the end edges side.

7. The sheet stacking apparatus according to claim 5, further comprising:

a sheet detecting section adapted to detect presence or absence of the sheet in the stacking section, wherein for a period during which the sheet detecting section detects the sheet, the control section causes the pair of aligning sections to wait in predetermined regulation positions for regulating a shift of the sheet discharged to the stacking apparatus to the other one of the end edges side.

8. The sheet stacking apparatus according to claim 5, further comprising:

a sheet width acquiring section adapted to acquire a width of a sheet discharged to the stacking section, wherein when the width of the sheet discharged to the stacking section acquired by the sheet width acquiring section is a sheet with a width narrower than the sheet capable of being aligned by the pair of aligning sections, in the pair of aligning sections, the control section controls the aligning sections and the shift section so that the aligning section on the other one of the end edges side regulates a shift of the sheet discharged to the stacking section to the other one of the end edges side.

9. The sheet stacking apparatus according to claim 5, wherein the sheet is an envelope sheet including a thick portion by a fold of a flap portion in one of the end edges along the discharge direction, or a sheet including a thick portion by printing on a part of a surface.

10. An image forming system comprising:

an image forming apparatus adapted to form an image on a sheet; and the sheet stacking apparatus according to claim 5 to stack the sheet discharged from the image forming apparatus.

* * * * *